US008454112B2

(12) United States Patent
Suzuki

(10) Patent No.: US 8,454,112 B2
(45) Date of Patent: Jun. 4, 2013

(54) LIQUID EJECTION APPARATUS

(75) Inventor: Yoshihumi Suzuki, Ena (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 313 days.

(21) Appl. No.: 13/030,892

(22) Filed: Feb. 18, 2011

(65) Prior Publication Data

US 2011/0234671 A1 Sep. 29, 2011

(30) Foreign Application Priority Data

Mar. 23, 2010 (JP) ..... 2010-065583

(51) Int. Cl.
*B41J 29/38* (2006.01)

(52) U.S. Cl.
USPC ..... 347/14; 347/11

(58) Field of Classification Search
USPC ..... 347/13, 14, 27, 35
See application file for complete search history.

(56) References Cited

U.S. PATENT DOCUMENTS 6,685,291 B1 2/2004 Naoi
2005/0078145 A1 4/2005 Inoue

FOREIGN PATENT DOCUMENTS

JP H10-258523 A 9/1998
JP 2001-150657 A 6/2001
JP 2003-072079 A 3/2003
JP 2003-080702 A 3/2003
JP 2005-119284 A 5/2005
JP 2008-080740 A 4/2008
JP 2009-179015 A 8/2009
JP 2009-220372 A 10/2009

OTHER PUBLICATIONS

Japan Patent Office, Notice of Reasons for Rejection for Japanese Patent Application No. 2010-065583 (counterpart Japanese patent application), mailed Oct. 16, 2012.
Japan Patent Office, Notice of Reasons for Rejection for Japanese Patent Application No. 2010-065583 (counterpart Japanese patent application), mailed Jul. 24, 2012.

*Primary Examiner* — Stephen Meier
*Assistant Examiner* — Tracey McMillion
(74) *Attorney, Agent, or Firm* — Baker Botts L.L.P.

(57) ABSTRACT

Provided that at least one of a plurality of recording media which are successively conveyed by a conveyance mechanism is a reference recording medium, a liquid ejection apparatus determines, for an ejection surface, an ejection region which opposes a recording region on the reference recording medium when the medium is being conveyed and a non-ejection region which does not oppose the recording region. Both of the ejection openings in the ejection region and the ejection openings in the non-ejection region carry out at least one of preliminary ejection and preliminary vibration in a recovery period. An amount of ejection of liquid in the preliminary ejection and the frequency of vibration of meniscus in the preliminary vibration are larger in the ejection openings in the ejection region than in the ejection openings in the non-ejection region.

17 Claims, 12 Drawing Sheets

LIQUID EJECTION APPARATUS

CROSS REFERENCE TO RELATED APPLICATION

The present application claims priority from Japanese Patent Application No. 2010-65583, which was filed on Mar. 23, 2010, the disclosure of which is herein incorporated by reference in its entirety.

BACKGROUND OF THE INVENTION

1. Field of the Invention

The present invention relates to a liquid ejection apparatus recording an image on a recording medium by ejecting droplets.

2. Description of the Related Art

A known technology prevents the viscosity of ink around ejection openings of an inkjet head from increasing such that, immediately before the printing is carried out, preliminary vibration is carried out to vibrate the meniscus on condition that no ink droplet is ejected, i.e. non-ejection flushing is carried out only for those ejection openings opposing the sheet. As a result the increase in the ink viscosity is restrained around the ejection openings, while power saving is achieved because the preliminary vibration is not performed at the ejection openings not opposing the sheet.

SUMMARY OF THE INVENTION

According to the technology above, because the preliminary vibration is not performed at the ejection openings not opposing the sheet, the viscosity of the ink around those ejection openings not opposing the sheet gradually increases when printing is successively carried out on a plurality of sheets of the same size.

An object of the present invention is to provide a recording apparatus which is able to achieve both the restraint of increase in the liquid viscosity around ejection openings and power saving.

A liquid ejection apparatus of the present invention includes a conveyance mechanism, a liquid ejection head, a determining unit, and a recovery action control unit. The conveyance mechanism conveys recording media in a conveyance direction. The liquid ejection head has an ejection surface on which a plurality of ejection openings ejecting droplets are aligned in a direction orthogonal to the conveyance direction and a plurality of actuators which generate an ejection energy causing the droplets to be ejected through the ejection openings. The determining unit determines, in the ejection surface, an ejection region which opposes, when the recording media are being conveyed, a recording region where an image is recorded on a reference recording medium which is at least one of the recording media successively conveyed by the conveyance mechanism and a non-ejection region which does not oppose the recording region when the recording media are being conveyed. The recovery action control unit controls the actuators such that, both in the ejection openings in the ejection region and in the ejection openings in the non-ejection region, at least one of preliminary ejection with which the droplets are ejected through the ejection openings and preliminary vibration with which meniscus of liquid at each of the ejection openings is vibrated without allowing the ejection openings to eject the droplets is carried out in a recovery period in which none of the ejection openings opposes a recording region on each of the recording media on which region an image is recorded. The recovery action control unit controls the actuators such that an ejection amount of the liquid regarding the preliminary ejection in the recovery period is larger in the ejection openings in the ejection region than in the ejection openings in the non-ejection region and a frequency of vibration of the meniscus regarding the preliminary vibration in the recovery period is higher in the ejection openings in the ejection region than in the ejection openings in the non-ejection region.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
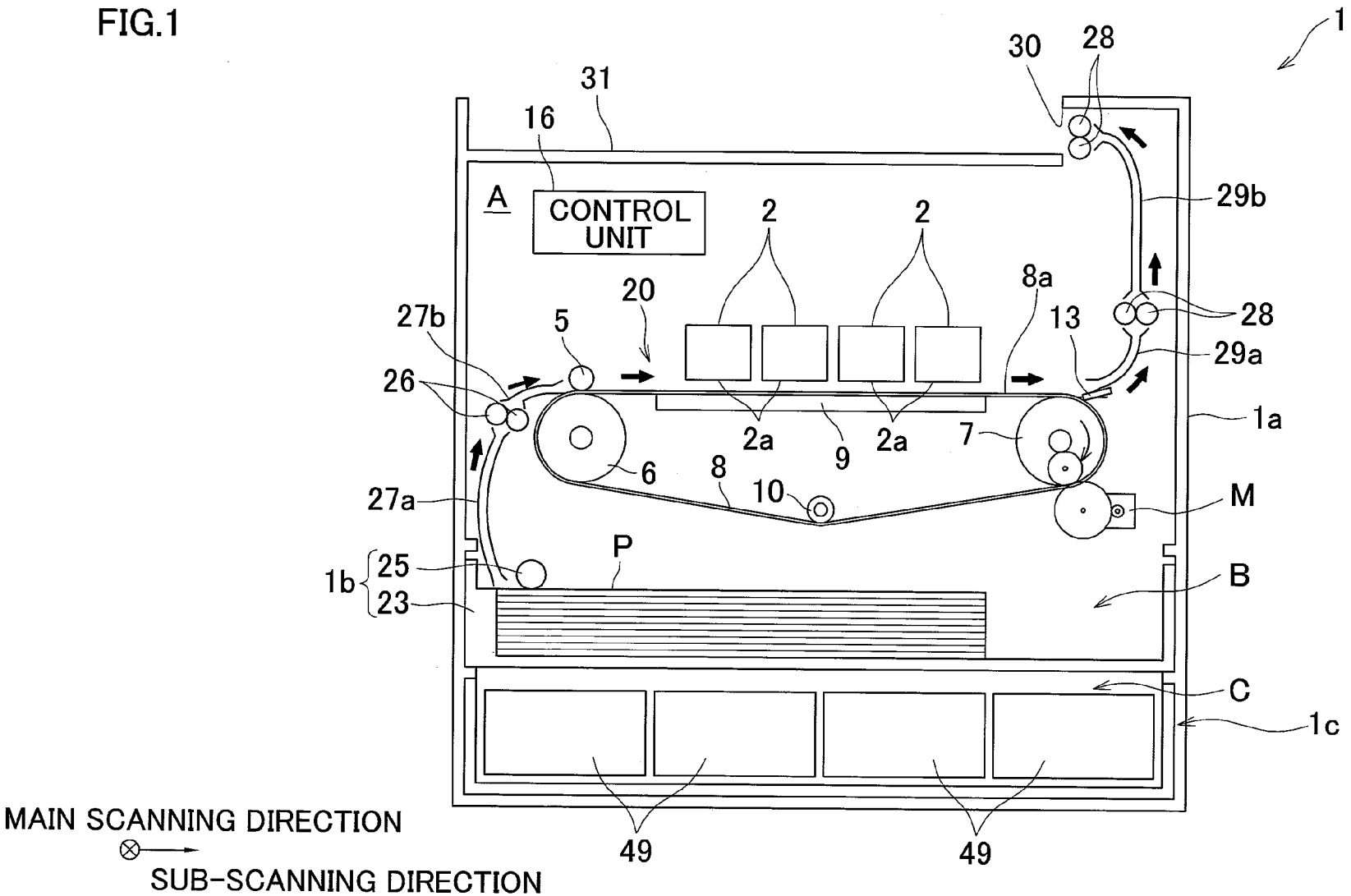
FIG. 1 schematically shows the internal structure of an inkjet printer according to an embodiment of the present invention.

An inkjet printer 1 according to an embodiment of the present invention is a line-type color inkjet printer. The printer 1 has, as shown in FIG. 1, a rectangular parallelepiped chassis 1*a*. At the upper part of the chassis 1*a* is provided an area 31 where ejected papers are stacked. The space in the chassis la is divided into three spaces A, B, and C which are provided in this order from above. The spaces A and B accommodate a conveying path for conveying sheets, which is connected to the area 31. The space A is for conveyance of sheets and image formation onto sheets. The space B is for storage and sending out of sheets. The space C accommodates an ink supply source.

The space A is provided with four inkjet heads 2, a conveyance mechanism 20 which horizontally conveys sheets, and two guide units defining parts of the conveying path of sheets. The space A is further provided with a control unit 16 which controls the operation of the printer 1. The four heads 2 are line heads which are long in the main scanning direction, and are aligned at predetermined intervals in the sub-scanning direction. Each head 2 is substantially rectangular parallelepiped in appearance. From the lower surfaces of the respective heads 2, i.e. ejection surfaces 2*a*, ink droplets of magenta, cyan, yellow, and black colors are ejected.

As shown in FIG. 1, the conveyance mechanism 20 includes components such as belt rollers 6 and 7, an endless conveyance belt 8 stretched between the rollers 6 and 7, a nipping roller 5 and a peeling plate 13 provided outside the conveyance belt 8, and a platen 9 and a tensioning roller 10 provided inside the conveyance belt 8. The belt roller 7 is a drive roller and rotated clockwise in FIG. 1 by a conveyance motor M. In response to this, the conveyance belt 8 moves along the thick arrows. The belt roller 6 is a driven roller and is rotated clockwise in FIG. 1 in accordance with the movement of the conveyance belt 8. The nipping roller 5 is disposed to oppose the belt roller 6 and presses a sheet P supplied from the guide unit of the preceding stage onto an outer circumferential surface 8*a* of the conveyance belt 8. The peeling plate 13 is disposed to oppose the belt roller 7 and peels a sheet P off from the outer circumferential surface 8*a* and guides it to the guide unit of the subsequent stage. The platen 9 is provided to oppose the four heads 2, and supports from the inside the upper part of the loop of the conveyance belt 8. Thanks to the components above, a predetermined gap suitable for image formation is formed between the outer circumferential surface 8*a* and the ejection surfaces 2*a* of the heads 2. The tensioning roller 10 biases the lower part of the loop downward. This prevents the conveyance belt 8 from being loose.

The two guide units are provided to sandwich the conveyance mechanism 20. The guide unit upstream of the conveyance mechanism 20 has two guides 27*a* and 27*b* defining a space which is a part of the conveying path of sheets, and also has a pair of forwarding rollers 26. This guide unit connects the sheet supply unit 1*b* with the conveyance mechanism 20. The guide unit downstream of the conveyance mechanism 20 has two guides 29*a* and 29*b* defining a space which is a part of the conveying path of sheets, and also has two pairs of forwarding rollers 28. This guide unit connects the conveyance mechanism 20 with the area 31. In each guide unit, sheets P are conveyed along the guides 27*a*, 28*b*, 29*a*, and 29*b*.

The space B is provided with a sheet supply unit 1*b*. This sheet supply unit 1*b* has a sheet feeding tray 23 and a pickup roller 25. The sheet feeding tray 23 is detachable from the chassis 1*a*. The sheet feeding tray 23 is an open-top box storing a plurality of stacked sheets P. The pickup roller 25 sends out the topmost sheet P in the sheet feeding tray 23, and supplies the sheet to the guide unit of the subsequent stage.

As such, in the space A and the space B is formed the conveying path extending from the sheet supply unit 1*b* to the area 31 via the conveyance mechanism 20. The sheet P sent out from the sheet feeding tray 23 is supplied to the conveyance mechanism 20 by the forwarding rollers 26. As the sheet P passes through the areas immediately below the respective heads 2 in the sub-scanning direction, the four heads 2 serially eject ink droplets, with the result that a color image is formed on the sheet P. The sheet P is peeled off from the conveyance belt 8 at the right edge of the conveyance belt 8, and is further conveyed upward by the two pairs of forwarding rollers 28. The sheet P is then ejected to the area 31 through the upper opening 30.

It is noted that the sub-scanning direction above is a direction in parallel to the conveyance direction in which the sheets P are conveyed by the conveyance mechanism 20, whereas the main scanning direction is in parallel to the horizontal plane and orthogonal to the sub-scanning direction.

The space C is provided with an ink tank unit 1*c* which is detachable from the chassis 1*a*. This ink tank unit 1*c* stores four ink tanks 49 which are aligned in the conveyance direction. The ink in each ink tank 49 is supplied to the corresponding head 2 via an unillustrated tube.

Figure 3:
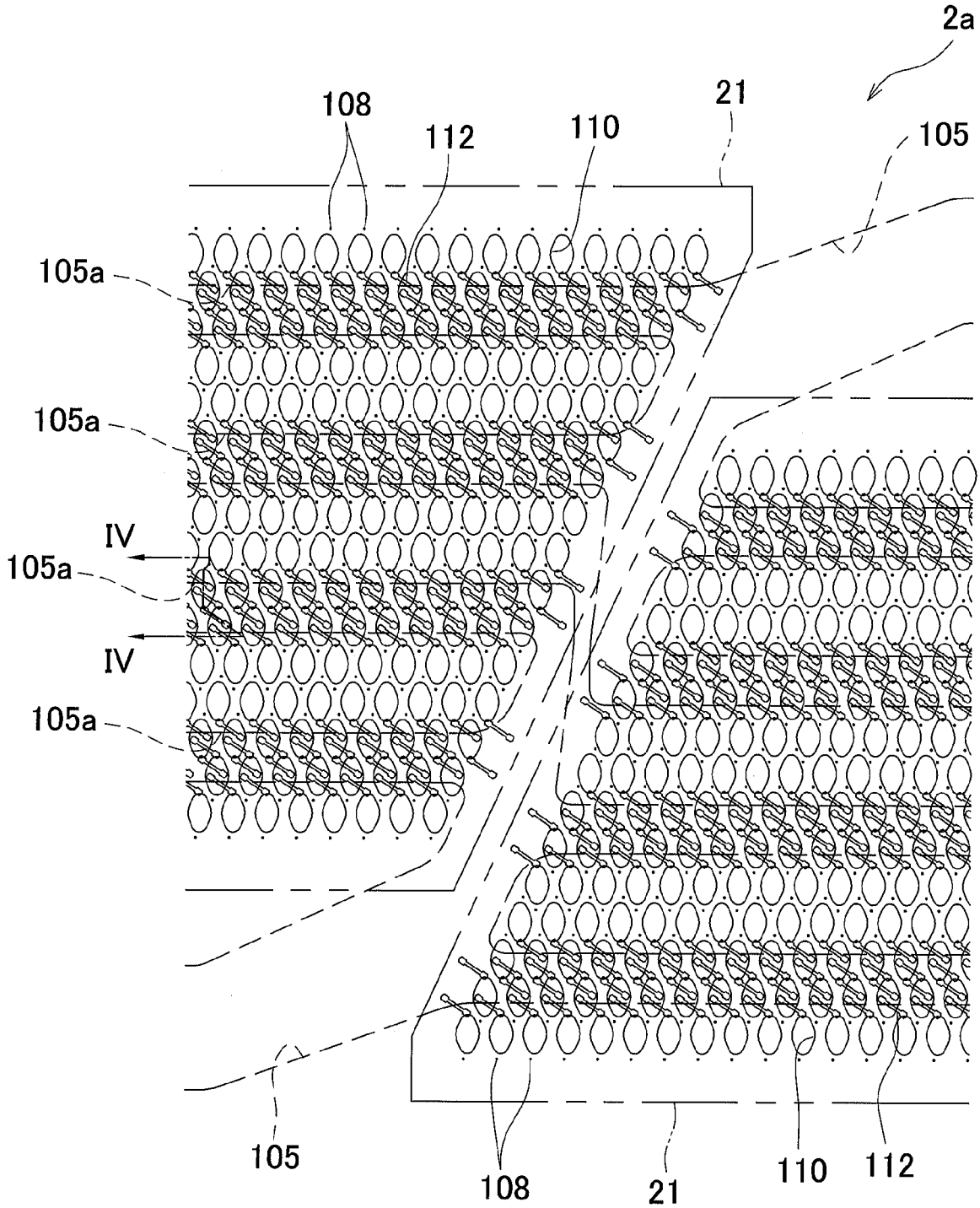
FIG. 3 is an enlarged view of the region enclosed by the dashed line in FIG. 2.

Now, the heads 2 will be described. In FIG. 3, pressure chambers 110, apertures 112, and ejection openings 108 are illustrated by full lines, although they are below the actuator units 21 and should be indicated by dotted lines.

Figure 2:
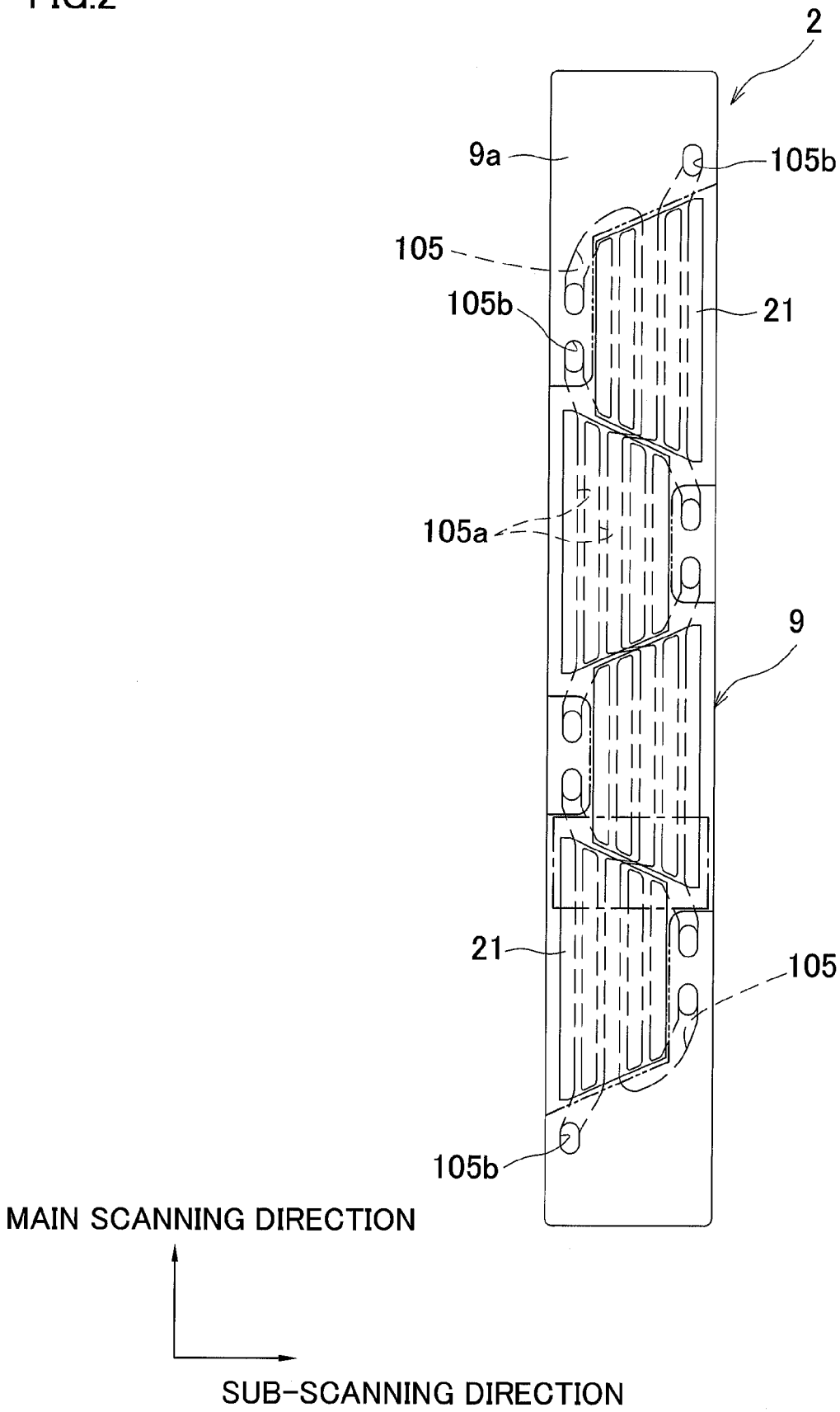
FIG. 2 is a plan view of the inkjet head of FIG. 1.

As shown in FIG. 2, each head 2 includes a passage unit 9 and four actuator units 21 fixed to the upper surface 9*a* of the passage unit 9. The passage unit 9 is rectangular parallelepiped and is rectangular in plane. The upper surface 9*a* of the passage unit 9 has ten ink supply openings 105*b*. In the passage unit 9, a plurality of ink passages are formed to connect the ink supply openings 105*b* on the upper surface 9*a* with the ejection openings 108 on the lower surface. In the present embodiment, the ejection surface 2*a* which is the lower surface of the passage unit 9 has a plurality of ejection openings 108 which are two-dimensionally aligned at regular intervals in the direction (main scanning direction) orthogonal to the conveyance direction. As a modification, the ejection surface 2*a* may have a plurality of ejection openings 108 which are at regular intervals and form a single line in the main scanning direction. The upper surface 9*a* (where the actuator units 21 are fixed) of the passage unit 9 has a plurality of pressure chamber 110 arranged in a matrix manner.

According to the present embodiment, in the area where the passage unit 9 overlaps the later-detailed actuator unit 21 in plan view, 16 columns of pressure chambers 110 extending along the length of the passage unit 9 are provided widthwise to be in parallel to one another and at equal intervals. The number of pressure chambers 110 in each pressure chamber row decreases from the long side (bottom) to the short side (top) in accordance with the outer shape (trapezoid) of the actuator unit 21. A plurality of ejection openings 108*a* overlapping the actuator unit 21 in plan view are disposed in the same manner as the pressure chambers 110.

Figure 4:
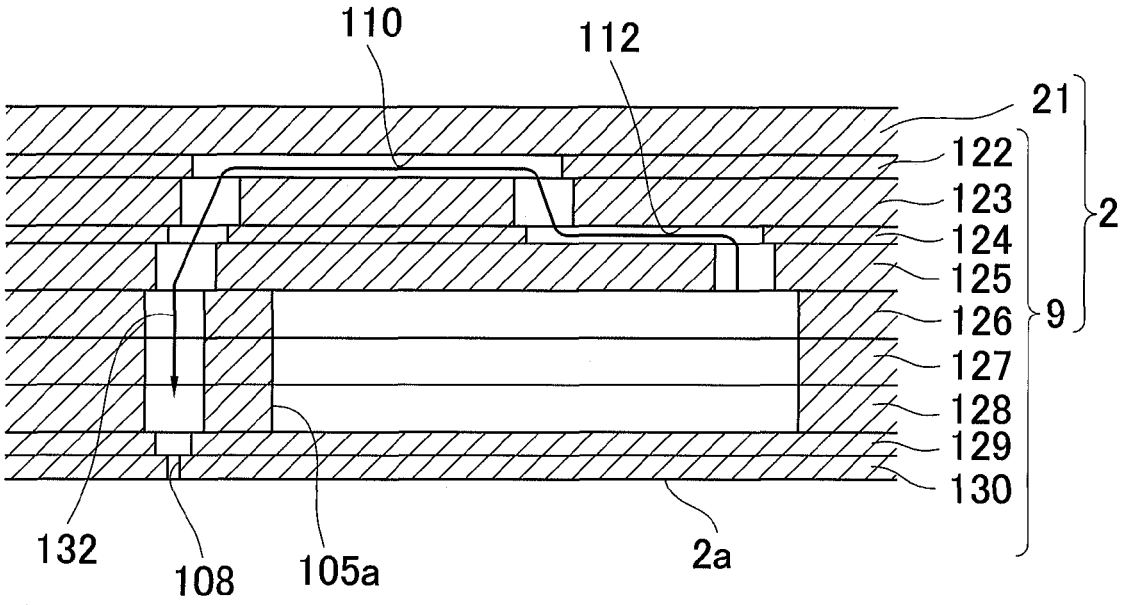
FIG. 4 is a cross section taken at the IV-IV line in FIG. 3.

As shown in FIG. 4, the passage unit 9 is constituted by nine metal plates 122-130 made of stainless steel. These plates 122-130 are aligned and stacked, with the result that manifold passages 105 connected to ink supply openings 105*b* and sub-manifold passages 105*a* branching from the manifold passages 105 are formed in the passage unit 9. In the passage unit 9, furthermore, a plurality of individual ink flow passages 132 are formed from the outlets of the sub-manifold passages 105*a* to the ejection openings 108 via the pressure chambers 110.

Now, the flow of ink in the passage unit 9 will be described. The ink supplied to the passage unit 9 via the ink supply openings 105*b* is distributed into the sub-manifold passages 105*a* via the manifold passages 105. The ink in the sub-manifold passage 105*a* flows into the individual ink flow passage 132, and then reaches the ejection opening 108 via an aperture 112 functioning as a throttle and a pressure chamber 110.

Figure 5:
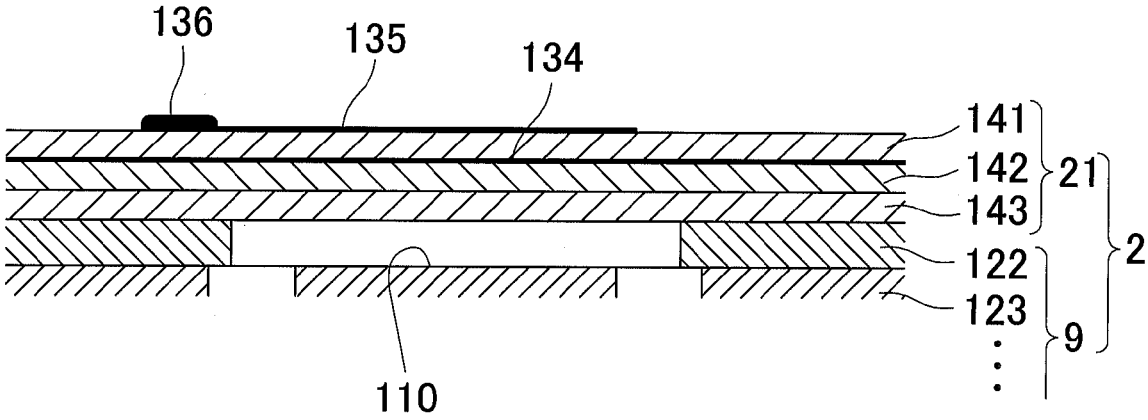
FIG. 5 is a partial cross section of the actuator unit of FIG. 3.

Now, the actuator unit 21 will be described. The actuator unit 21 has a plurality of actuators corresponding to the respective pressure chambers 110, and selectively imparts an ejection energy to the ink in the pressure chambers 110. A single actuator corresponds to, as described later, a part of a laminated body constituted by piezoelectric sheets 141-143 which part opposes the individual electrode 135. As shown in FIG. 5, the actuator unit 21 is constituted by three piezoelectric sheets 141-143 made of a lead zirconate titanate (PZT)

ceramic material exhibiting ferroelectricity. On the upper surface of the topmost piezoelectric sheet 141, an individual electrode 135 is formed to oppose the pressure chamber 110. Between the topmost piezoelectric sheet 141 and the piezoelectric sheet 142 immediately below the same, a common electrode 134 is provided to cover the entire sheet. Being analogous to the pressure chamber 110, the individual electrode 135 is substantially rhomboidal in plan view. In plan view, the most part of the individual electrode 135 overlaps the pressure chamber 110. One of the acute angles of the substantially rhomboid individual electrode 135 reaches beyond the pressure chamber 110, and an individual bump 136 electrically connected to the individual electrode 135 is provided at the tip of said one of the acute angles.

The common electrode 134 receives a ground potential equally at all regions corresponding to the respective pressure chambers 110. On the other hand, the individual bumps 136 are electrically connected to the respective output terminals of a driver IC on a thin-film mounted by COF (Chip On Film). Both of the drive IC and the output terminals are not illustrated. The driver IC amplifies a drive waveform based on an instruction from the control unit 16, and a drive signal generated thereby is supplied to the individual electrode 135 via the individual bump 136.

Now, a method of driving the actuator unit 21 will be described. The piezoelectric sheet 141 is polarized in its thickness direction. As the individual electrode 135 receives an electric potential different from the common electrode 134 so that an electric field in the polarization directions is applied to the piezoelectric sheet 141, a part of the piezoelectric sheet 141 in which part the electric field is applied (i.e. active portion) is deformed on account of the transversal piezoelectric effect. For example, when the polarization directions are in parallel to the direction of the application of the electric field, the active portion is deformed in the directions orthogonal to the polarization directions (i.e. deformed in the plane direction). The remaining piezoelectric sheets 142 and 143 are not actively deformed. For this reason, the actuator opposing a single pressure chamber 110 is deformed to convex toward the pressure chamber 110. To put it differently, the actuator unit 21 is constructed to include the same number of unimorph actuators as the pressure chamber 110, each of the unimorph actuators being structured so that the upper piezoelectric sheet 141 has an active portion whereas the lower piezoelectric sheets 142 and 143 which are closer to the pressure chamber 110 than the piezoelectric sheet 141 are inactive layers. The piezoelectric sheet 143 is fixed to the upper surface of the plate 122 defining the pressure chamber 110. For this reason, when there is a difference in strain in the plane directions between the active portion of the piezoelectric sheet 141 and the piezoelectric sheets 142 and 143 below the same, each actuator is deformed (unimorph deformation) in its entirety to convex toward the pressure chamber 110. As a result, a pressure (ejection energy) is imparted to the ink in the pressure chamber 110, and hence an ink droplet is ejected from the ejection opening 108.

In the present embodiment, both in a printing period in which ink is ejected onto a sheet P and a recovery period in which preliminary ejection and/or preliminary vibration both of which will be detailed later are carried out, a predetermined positive electric potential is imparted to the individual electrode 135 in advance, and after the individual electrode 135 is reset to the ground potential each time the ejection instruction is made, a drive signal including at least one pulse is output from the driver IC at a predetermined timing to impart the predetermined positive electric potential to the individual electrode 135. In other words, the drive signal includes a printing ejection signal supplied to the individual electrode 135 in the printing period and recovery signals (indicating a preliminary ejection signal and a preliminary vibration signal shown in FIGS. 8, 10, and 12) supplied to the individual electrode 135 in the recovery period. In this regard, the piezoelectric sheets 141-143 recover the original state when the electric potential of the individual electrode 135 is changed to the ground potential so that the capacity of the pressure chamber 110 becomes larger than the initial capacity (in which case a voltage is applied in advance), with the result that the ink is sucked from the sub-manifold passage 105*a* into the individual ink flow passage 132. Thereafter, the actuator is deformed to convex toward the pressure chamber 110 when the predetermined positive electric potential is imparted to the individual electrode 135 again, with the result that the pressure of the ink is increased on account of the decrease in the capacity of the pressure chamber 110 and hence the ink is ejected through the ejection opening 108.

When the printer 1 is on standby, the ejection surface 2*a* of the head 2 is sealed by an unillustrated capping component. In other words, the space facing a part of the ejection surface 2*a* in which part the ejection openings 108 are provided is separated from the external space. Receiving a printing instruction from a computer on the upper level, the printer 1 on standby is shifted to the printable state as the capping component is separated from the ejection surface 2*a*. After all printing operations related to the printing instruction are completed, the printer 1 causes the capping component to seal the ejection surface 2*a* again, and then the printer 1 is shifted to the standby state.

Figure 6:
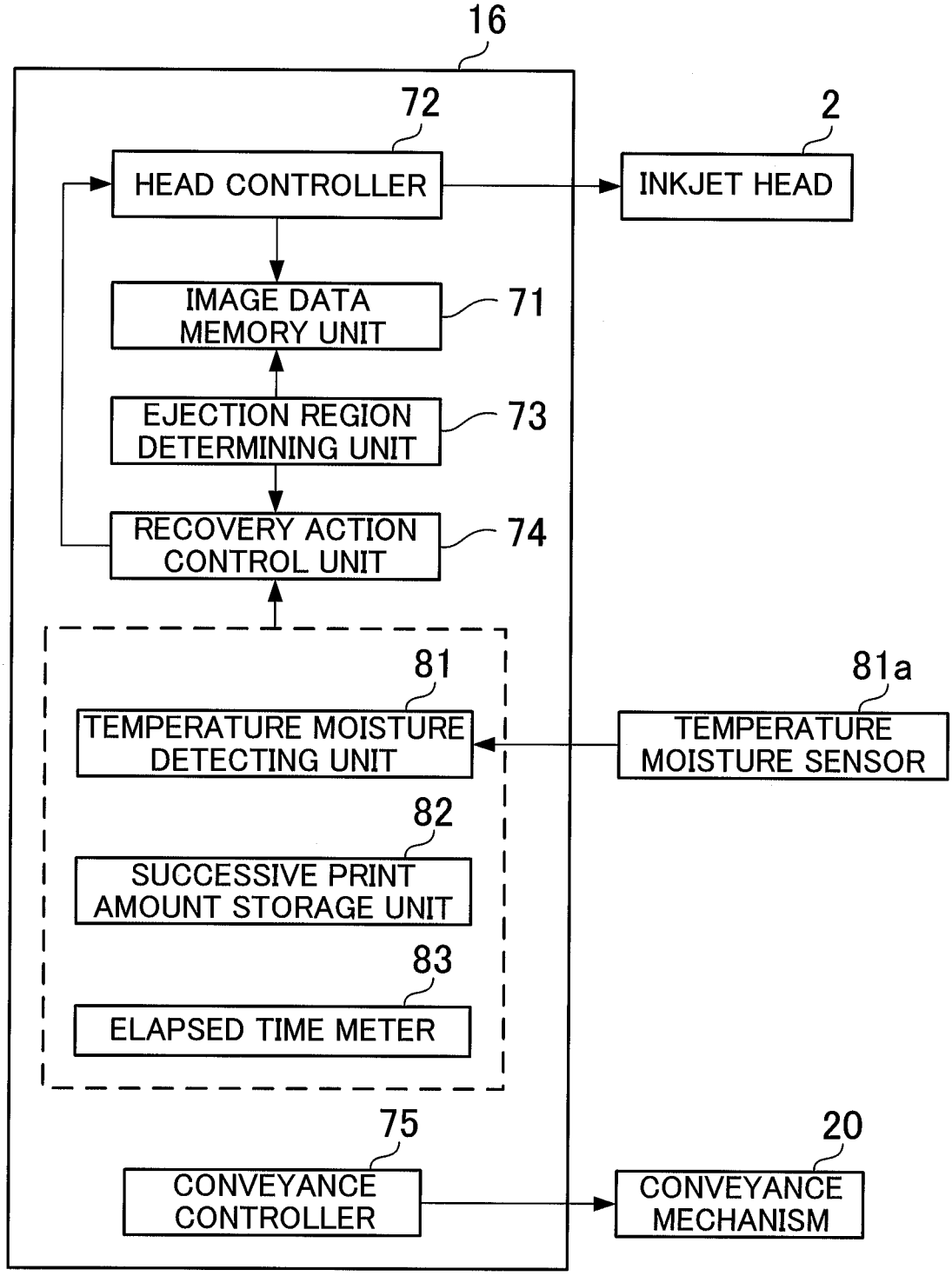
FIG. 6 is a functional block diagram of the control unit of FIG. 1.

Now, the control unit 16 will be described with reference to FIG. 6. The control unit 16 includes a CPU (Central Processing Unit), an EEPROM (Electrically Erasable and Programmable Read Only Memory) rewritably storing programs executed by the CPU and data used by the programs, and a RAM (Random Access Memory) temporarily storing data when a program is executed. The functional blocks in the control unit 16 are constructed by the cooperation of the hardware above and the software in the EEPROM. As shown in FIG. 6, the control unit 16 includes a conveyance controller 75, an image data memory unit 71, a head controller 72, an ejection region determining unit 73, a recovery action control unit 74, a temperature moisture detecting unit 81, a successive print amount storage unit 82, and an elapsed time meter 83.

The conveyance controller 75 controls a conveyance motor M of the conveyance mechanism 20 so that sheets P are conveyed in the conveyance direction. The image data memory unit 71 stores image data related to an image to be printed on a sheet P. For example, image data is supplied from a computer on the upper level, along with a printing instruction. The head controller 72 controls the operation of the head 2 by outputting a drive signal to each of the individual electrodes 135 in the actuator unit 21. The head controller 72 includes a driver IC.

Figure 7:
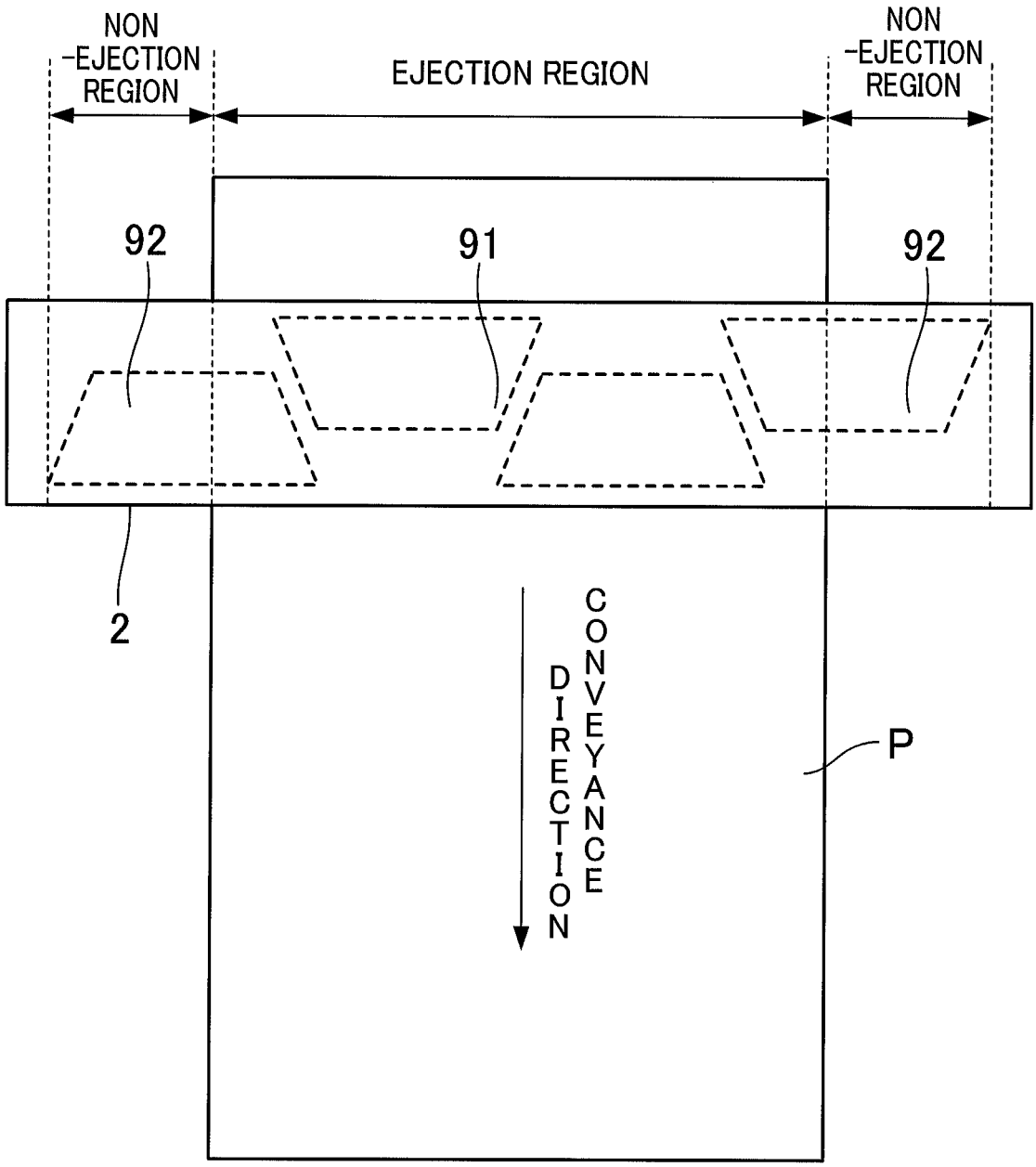
FIG. 7 illustrates what is determined by the ejection region determining unit of FIG. 6.

As shown in FIG. 7, the ejection region determining unit 73 determines, for each of the four heads 1, an ejection region 91 which opposes during the conveyance a printing region (which may be referred to as "reference printing region") on the ejection surface 2*a* in which region an image is formed on a reference sheet and a non-ejection region 92 which does not oppose the reference printing region during the conveyance. The reference printing region is defined for each of the four colors. The reference sheet is a sheet among a plurality of sheet P successively conveyed, which functions as a reference for determining an ejection region 91 and a non-ejection region 92. In the present embodiment, This ejection region determining process is conducted each time a sheet P is conveyed. In other words, this ejection region determining process is carried out each time before the start of the recovery period of each reference sheet immediately before the printing period thereof, provided that each of sheets P which are successively conveyed is dealt with as a reference sheet. More specifically, when a sheet P1 is conveyed, the ejection region determining unit 73 detects a printing region in the sheet P1 from the image data of the image to be printed on the sheet P1 which data is stored in the image data memory unit 71, so as to determine two types of regions 91 and 92 based on the length and position of the printing region in the main scanning direction. When another sheet P2 is conveyed, the ejection region determining unit 73 detects a printing region in the sheet P2 from the image data of the image to be printed on the sheet P2 which data is stored in the image data memory unit 71, so as to determine two types of regions 91 and 92 based on the length and position of the printing region in the main scanning direction. Then the ejection region determining unit 73 specifies ejection openings 108 which will oppose the reference printing region during the conveyance by the conveyance mechanism 20 and ejection openings 108 which will not oppose the reference printing region, and the resulting information is stored in the RAM. When all of the sheets P which are successively conveyed are reference sheets, the ejection region determining unit 73 classifies the plurality of ejection opening 108 on the ejection surface 2*a* into those ejecting droplets onto the printing region of each reference sheet and those not ejecting droplets. The result of the determination by the ejection region determining unit 73 is stored until the printing on all of the successively-conveyed sheets is finished.

The minimum number of reference sheets is one in a plurality of sheets which are successively conveyed, and may be the sheet which is conveyed first, for example. In particular, when the same image is printed on a plurality of sheets of the same size, it is sufficient to set only the sheet conveyed first as a reference sheet. When the size of the sheets subsequently conveyed is changed before the completion of the printing on all sheets or when an image printed on the sheets is changed before the completion of the printing on all sheets, it is preferable that the first sheet after the change is set as another reference sheet. It is noted that, when a sheet which is not a sheet conveyed first is chosen as the first reference sheet, the operations described below are not carried out in the recovery periods before the printing period of that first reference sheet. Also, "sheets successively conveyed" are not limited to those conveyed in response to a single printing instruction, and may also indicate sheets conveyed in response to two or more printing instructions, on condition that the printer is not shifted to the standby state while those sheets are being conveyed. Furthermore, a single reference sheet P may have a plurality of printing regions distanced from one another in the main scanning direction.

The temperature moisture detecting unit 81 detects a temperature and a moisture around the head 2 by a temperature moisture sensor 81*a* provided in the vicinity of the head 2. The successive print amount storage unit 82 stores the number of sheets P which are successively printed. As described below, the number of sheets stored in the successive print amount storage unit 82 is reset to 0, i.e. initialized, when the printer 1 in the standby state receives a printing instruction and printing preparation is carried out, and the number of sheets is incremented by 1 each time the printing on a single sheet P is completed. The elapsed time meter 83 measures, for each head 2, an elapsed time t from the timing at which the ejection of ink droplets from all ejection openings 108 onto the immediately previous sheet P ends to the start of the immediately subsequent recovery period, i.e. measures a non-ejection duration. More specifically, the elapsed time meter 83 measures a non-ejection duration from the timing at which the ejection of ink droplets from the ejection openings 108 onto a sheet Pm-1 which is the (m-1)th sheet (m is a natural number not smaller than 2) among a plurality of sheets P successively conveyed ends to the timing to start a recovery period Qm between the printing on the (m-1)th sheet Pm-1 and the printing on the m-th sheet Pm (see FIG. 8).

The recovery action control unit 74 drives, in a recovery period, the actuator unit 21 of each head 2 by the head controller 72 so that at least one of the preliminary ejection and the preliminary vibration (at least the preliminary vibration in the present embodiment) is carried out. As a modification, the recovery action control unit 74 may drive the actuator unit 21 of each head 2 by the head controller 72 so that at least the preliminary ejection is carried out among the preliminary ejection and the preliminary vibration. The preliminary ejection and the preliminary vibration constitute a recovery action to maintain or recover the ejection characteristics of each head 2. The preliminary ejection causes each ejection opening 108 to eject an ink droplet not based on image data received along with a printing instruction, whereas the preliminary vibration causes the meniscus formed at each ejection opening 108 to vibrate without allowing an ink droplet to be ejected. In the present embodiment, in each head 2, a recovery period ends when the downstream end of the sheet Pm in the conveyance direction, i.e. the leading end of the sheet Pm opposes the ejection surface 2*a* (preferably immediately before the leading end of the sheet Pm opposes the most upstream ejection opening 108 on the ejection surface 2*a*), and starts at the timing which is before the end for a predetermined time. The predetermined time is adjustable on condition that no ejection openings 108 on the ejection surface 2*a* of that head 2 oppose a printing region of the immediately preceding sheet Pm-1 (i.e. a region which is not a reference printing region but a region on the actually-conveyed sheet Pm-1 where the image is printed; hereinafter, this region may be referred to as "actual printing region") at the start timing. The end timing of the recovery action is also adjustable on condition that none of the ejection openings 108 opposes the actual printing region of the sheet m. The recovery action is carried out for the head 2 having those ejection surfaces 2*a*.

Figure 8:
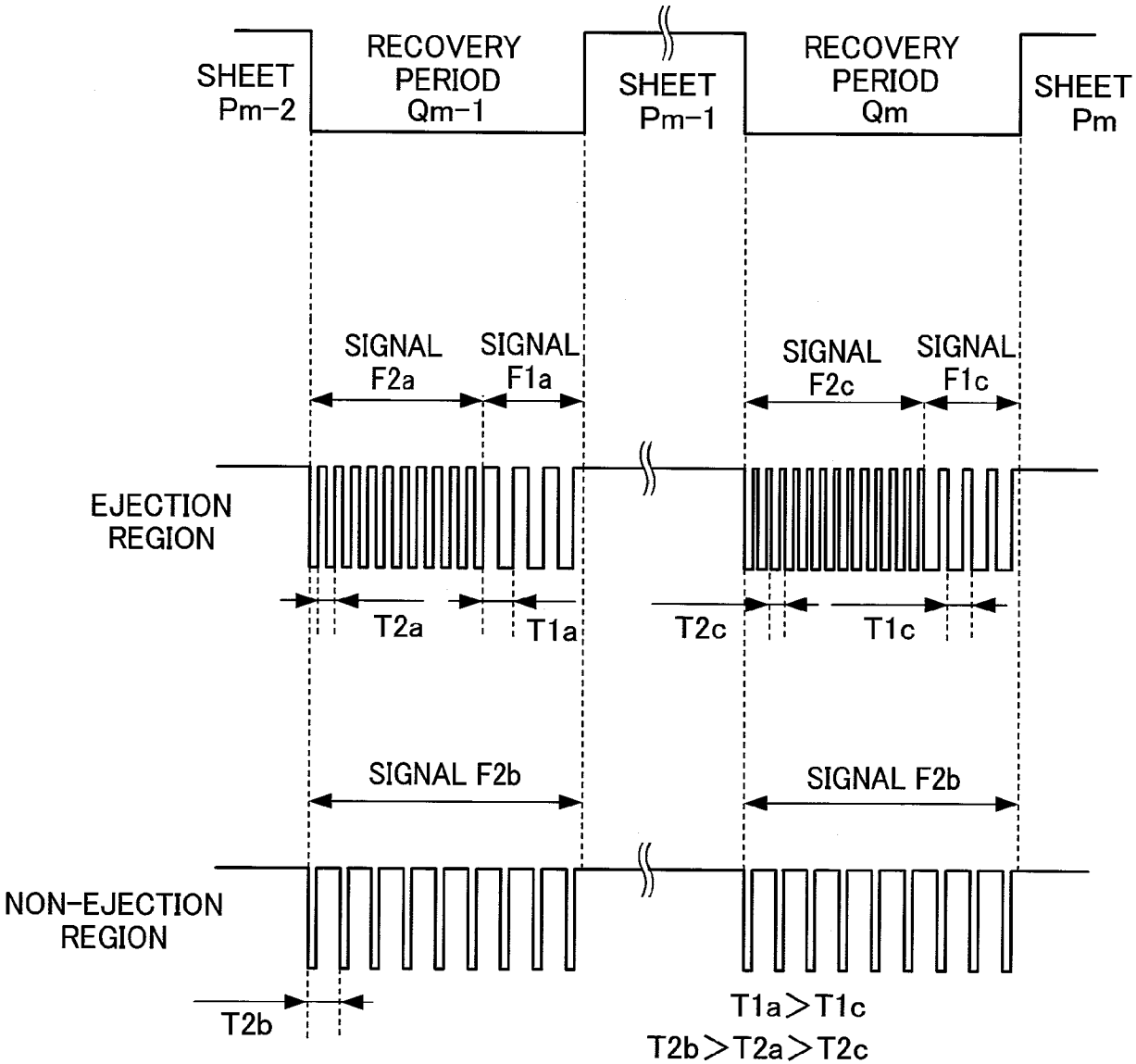
FIG. 8 details the recovery action control unit of FIG. 6, and shows examples of the recovery action immediately before the printing onto the (m-1)th sheet and the recovery action immediately before the printing onto the m-th sheet, when the (m-1)th sheet and the m-th sheet are different from each other in the size of the printing region.
Figure 10:
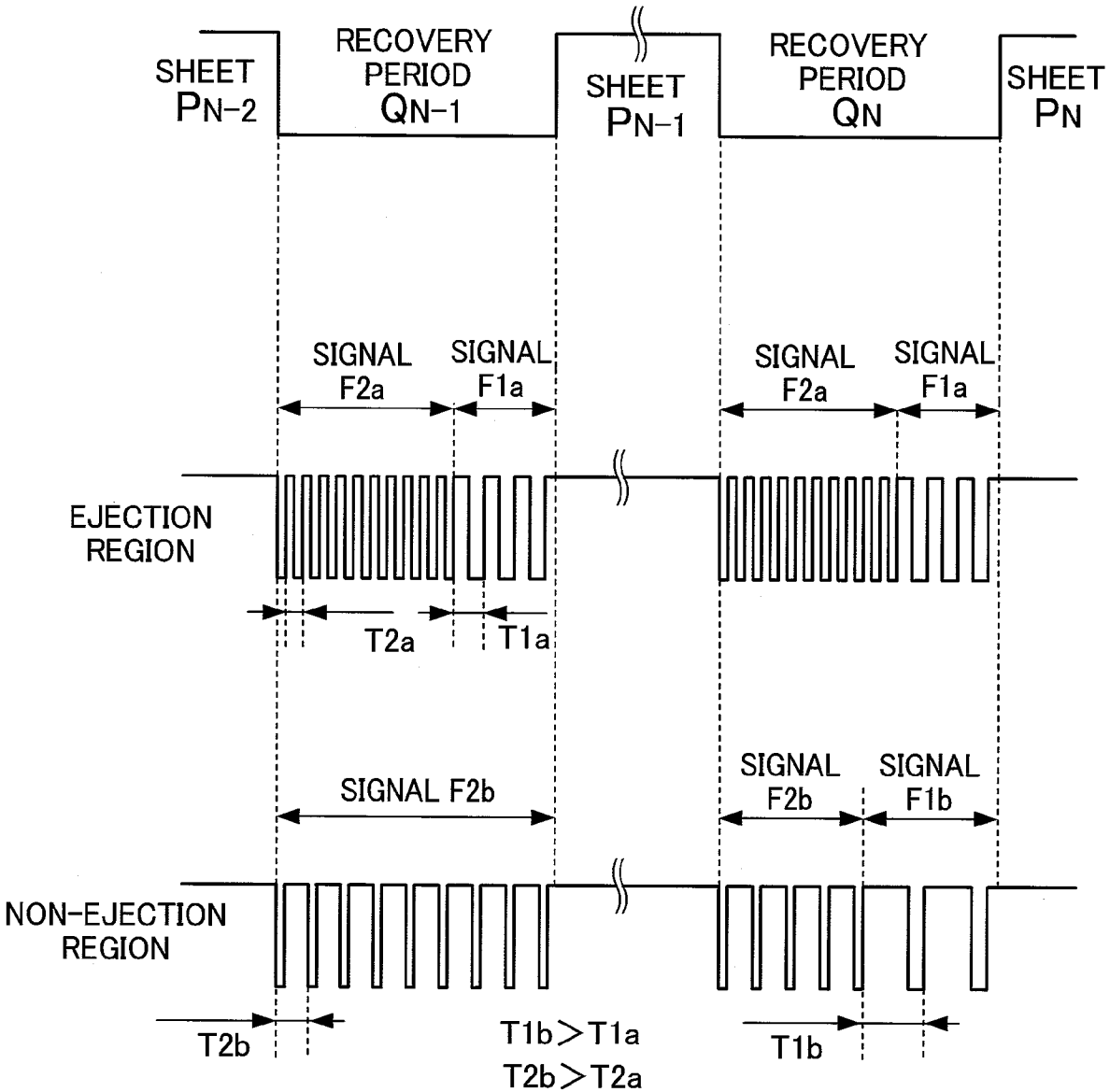
FIG. 10 details the recovery action control unit of FIG. 6, and shows examples of the recovery action immediately before the printing onto the (N-1)th sheet and the recovery action to immediately before the printing onto the N-th sheet, when N or more sheets of the same size are successively conveyed.

FIG. 8 and FIG. 10 are timing charts in each of which the topmost row shows that the recovery periods defined as above are indicated by low levels whereas the other periods (printing periods) are indicated by high levels. During the high level periods, the ejection surface 2*a* of the head 2 opposes a sheet P. On the other hand, in usual cases, the ejection surface 2*a* does not oppose a sheet P during most of the recovery periods which correspond to the low level.

In the topmost row of FIG. 8, indices m are assigned to a plurality of sheets P which are successively conveyed, in order to indicate the order of conveyance. In this example, all sheets P to be conveyed have the same size, and the scope of the reference printing region of the sheets P1 to Pm-1 is different from the scope of the reference printing region of the sheet Pm.

Figure 9A:
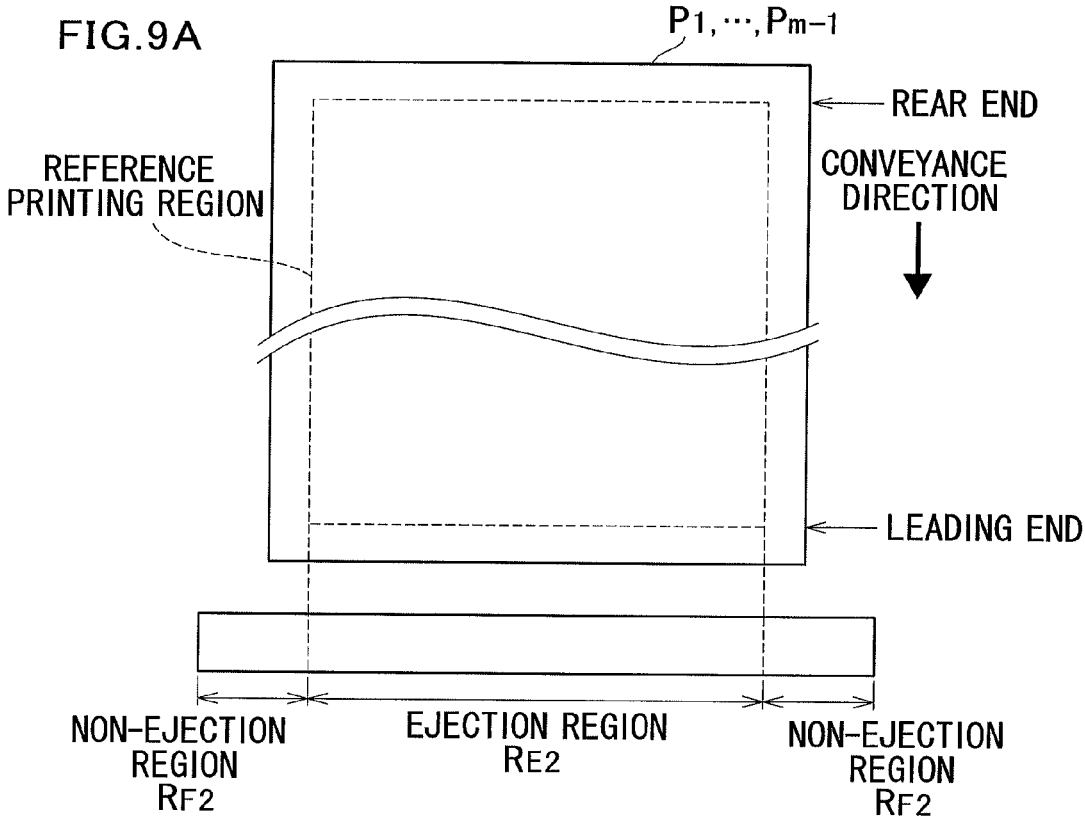
FIG. 9A and FIG. 9B schematically show the relations between the reference printing region and the ejection region.
Figure 9B:
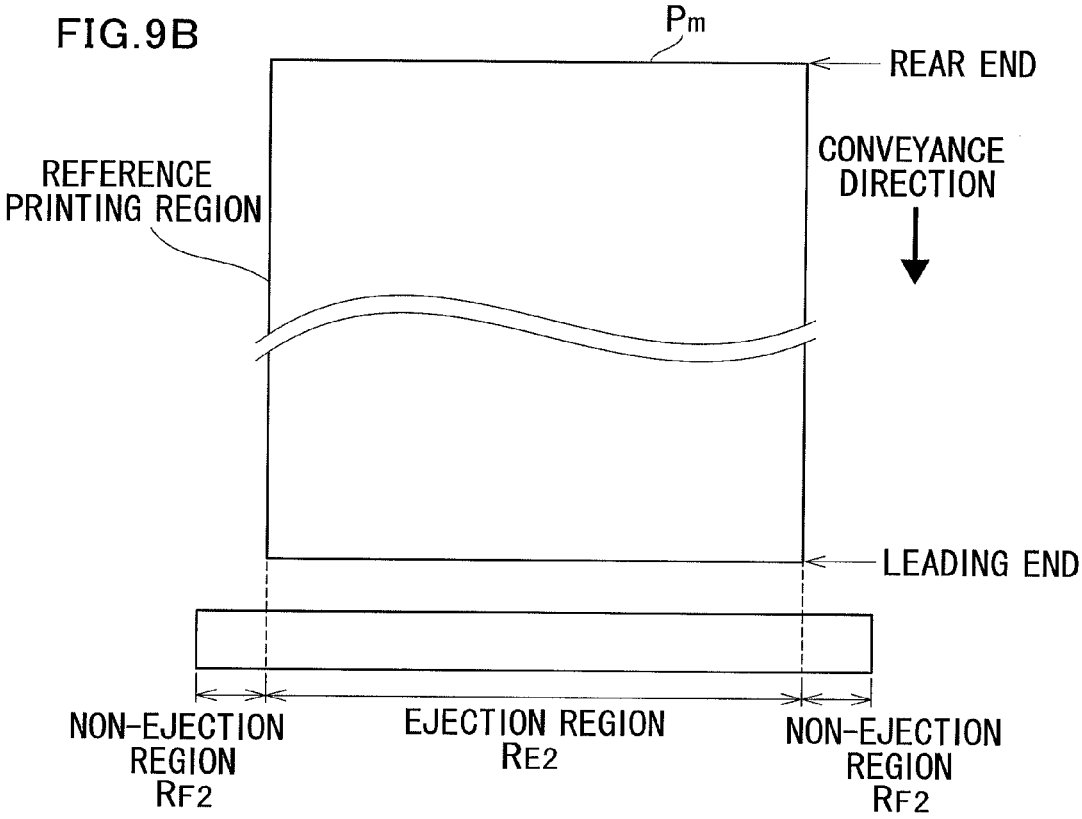

A specific example will be described with reference to FIG. 9A and FIG. 9B. As shown in FIG. 9A, framed printing is conducted onto the sheet P1 to Pm-1. Therefore in each sheet P there are margins between the reference printing region and the outer edges. For these sheets P1 to Pm-1, regarding the ejection surface 2*a*, an ejection region RE1 and two non-ejection regions RF1 are determined based on the position and length of the reference printing region on each of the sheets P1 to Pm-1 (more specifically, the regions are determined to correspond to the scope of the reference printing region). On the other hand, as shown in FIG. 9B, frameless printing is conducted onto the sheet Pm, and hence the reference printing region entirely covers the sheet P. Regarding the sheet Pm, for the ejection surface 2*a*, an ejection region RE2 and two non-ejection regions RF2 are determined based on the position and length of the reference printing region of the sheet Pm. In this case, the ejection region RE2 includes the entirety of the ejection region RE1 and a part of each non-ejection region RF1.

The middle row in FIG. 8 indicates a recovery action carried out for the ejection openings 108 in the ejection region RE1 during a recovery period Qm-1 (a period between the printing onto the sheet Pm-2 and the printing onto the sheet Pm-1) and a recovery action carried out for the ejection openings 108 in the ejection region RE2 during a recovery period Qm (a period between the printing onto the sheet Pm-1 and the printing onto the sheet Pm). The bottom row in FIG. 8 indicates a recovery action carried out for the ejection openings 108 in the non-ejection regions RF1 during the recovery period Qm-1 and a recovery action carried out for the ejection openings 108 in the non-ejection regions RF2 during the recovery period Qm.

In the topmost row in FIG. 10, indices N (which is a predetermined natural number not lower than 2) are assigned to respective sheets P which are successively conveyed in order to indicate the order of conveyance. In this example, assume that all sheets P1 to PN have the same size and have reference printing regions of the same scope. For example, provided that the sizes of the sheets P1 to PN and their reference printing regions are identical with those shown in FIG. 9A, for each of the ejection surfaces 2*a* of the sheets P1 to PN, an ejection region RE1 and two non-ejection regions RF1 are determined based on the position and length of the reference printing region of each of the sheets P1 to PN. In this case, the middle row in FIG. 10 indicates a recovery action carried out for the ejection openings 108 in the ejection region RE1 during a recovery period QN-1 (a period between the printing onto the sheet PN-2 and the printing onto the sheet PN-1) and a recovery action carried out for the ejection openings 108 in the ejection region RE1 during a recovery period QN (a period between the printing onto the sheet PN-1 and the printing onto the sheet PN). The bottom row in FIG. 10 indicates a recovery action carried out for the ejection openings 108 in the non-ejection regions RF 1 during the recovery period QN-1 and a recovery action carried out for the ejection openings 108 in the non-ejection regions RF1 during the recovery period QN. It is noted that the recovery action during the recovery period QN-1 is identical with the recovery action during the recovery period Qm-1 show in FIG. 8.

The recovery action control unit 74 generates three types of preliminary ejection signals F1*a*, F1*b*, and F1*c* and three types of preliminary vibration signals F2*a*, F2*b*, and F2*c* which are supplied to the individual electrode 135 during the recovery periods shown in FIG. 8 and FIG. 10. The preliminary ejection signals F1*a*, F1*b*, and F1*c* include successive pulses having ejection cycles T1*a*, T1*b*, and T1*c*, respectively. The preliminary vibration signals F2*a*, F2*b*, and F2*c* include successive pulses having vibration cycles T2*a*, T2*b*, and T2*c*, respectively. For example, the preliminary ejection signal F1*a* has a frequency of 20 kHz, whereas the preliminary vibration signal F2*a* has a frequency of 100 kHz. Receiving the preliminary ejection signals F1*a*, F1*b*, and F1*c*, the actuator causes ink droplets to be ejected through the ejection openings 108. On the other hand, receiving the preliminary vibration signals F2*a*, F2*b*, and F2*c*, the actuator causes the meniscus around each ejection opening 108 to vibrate without allowing ink droplets from being ejected through the ejection openings 108. The pulse height is identical among all signals.

The ejection cycle T1*b* is shorter than the ejection cycle T1*a*, and the ejection cycle T1*a* is longer than the ejection cycle T1*c*. The ink ejection amounts V1*a*, V1*b*, and V1*c* of the ink ejection through the ejection openings 108 per unit time are minimum in the case of the preliminary ejection signal F1*b* and is maximum in the case of the preliminary ejection signal F1*c* (V1*c*>V1*a*>V1*b*). This is because, with reference to the AL (Acoustic Length) of the individual ink flow passage 132, the pulse widths (low-level periods) of the ejection cycles T1*a*, T1*b*, and T1*c* are adjusted such that the ink ejection amounts per one pulse are identical with one another, and the ejection cycles T1*a*, T1*b*, and T1*c* are adjusted such that the pulse intervals (high-level periods) are the longest in the preliminary ejection signal F1*b* and the shortest in the preliminary ejection signal F1*c*.

The vibration cycle T2*b* is longer than the vibration cycle T2*a* and the vibration cycle T2*a* is longer than the vibration cycle T2*c*. Therefore the meniscus vibration frequency (the number of times the actuator is deformed to vibrate the meniscus) per unit time for the ejection openings 108 is the smallest in the preliminary vibration signal F2*b* and is the largest in the preliminary ejection signal F2*c*. The pulse widths (low-level periods) in the preliminary vibration signals F2*a*, F2*b*, and F2*c* are adjusted to be identical with one another on condition that the supply of the pulses does not cause ink droplets to be ejected through the ejection openings 108. The pulse intervals (high-level periods) in the preliminary vibration signals F2*a*, F2*b*, F2*c* are the longest in the preliminary vibration signal F2*b* and are the shortest in the preliminary vibration signal F2*c*.

In the present embodiment, typically the actuators of the ejection region 91 receive the preliminary vibration signal F2*a* in each recovery period first and then receive the preliminary ejection signal F1*a*, whereas the actuators of the non-ejection region 92 receive only the preliminary vibration signal F2*b* in each recovery period (see the recovery periods Qm-1 and QN-1 (see FIG. 8 and FIG. 10).

However, as described above, the sheet Pm-1 which is the (m-1)-th sheet to be conveyed and the sheet Pm which is the m-th sheet to be conveyed are different from each other in the reference printing regions. For this reason, when the ejection region RE2 includes at least a part of the non-ejection regions RF 1, the actuators of the ejection region 91 receive, as shown in FIG. 8, the preliminary ejection signal F1*c* after the preliminary vibration signal F2*c* is received in the recovery period Qm. As a result, the ink ejection amount and the meniscus vibration frequency of the ejection openings 108 in the ejection region 91 during the recovery period Qm are both larger than the ink ejection amount and the meniscus vibration frequency of the ejection openings 108 in the ejection region 91 during the recovery period Qm-1. In other words, when the ejection region 91 includes at least a part of the non-ejection regions 92, the ink ejection amount and the meniscus vibration frequency of the ejection openings 108 in the ejection region 91 during each recovery period Q are larger than those in case where the ejection region 91 does not include the non-ejection regions 92 at all. As a modification, only one of the ink ejection amount and the meniscus vibration frequency may be larger than the ink ejection amount or the meniscus vibration frequency in case where the ejection region 91 does not include the non-ejection regions 92 at all. In the meanwhile, in the same manner as usual, supplied to the actuators of the non-ejection region 92 in the recovery period Qm is only the preliminary vibration signal F2*b*.

Furthermore, when N or more sheets P are successively conveyed as in the case above, as shown in FIG. 10, the actuators concerning the ejection openings 108 in the non-ejection regions 92, which are shared by all of the N sheets P, receive the preliminary vibration signal F2*b* during the recovery period QN and then receive the preliminary ejection signal F1*b*. On the other hand, during the recovery period QN, the actuators in the ejection region 91 receive the preliminary vibration signal F2*a* and the preliminary ejection signal F1*a* in this order and in the same pattern, as in the case of the periods up to the recovery period QN-1. Such recovery actions are carried out each time N sheets P are successively conveyed.

The operations in the example above are carried out not only when N sheets P having the same size and the reference printing regions of the same scope are successively conveyed. The actuators concerning the ejection openings 108 in the non-ejection regions 92 of the N-th sheet PN receive the two signals F2*a* and F1*a* in the same pattern as in the immediately preceding recovery period QN shown in FIG. 10, irrespective of past changes in the reference printing region. Alternatively, the two signals F2*a* and F1*a* may be supplied in the same pattern as in the recovery period QN shown in FIG. 10, only to the actuators corresponding to the ejection openings 108 in the regions which are regarded as the non-ejection regions 92 in all of the successively supplied N sheets P.

In all recovery periods, the total number of pulses in the recovery signals (preliminary ejection signals F1*a*, F1*b*, and F1*c* and the preliminary vibration signals F2*a*, F2*b*, and F2*c*) supplied to the individual electrode 135 is larger in the ejection region 91 than in the non-ejection regions 92. For this reason, in all recovery periods, the frequency of the deformation of the actuators is larger in the ejection region 91 than in the non-ejection regions 92. Furthermore, in all recovery periods, the total number of pulses in the preliminary ejection signals F1*a*, F1*b*, and F1 supplied to the individual electrode 135 is larger in the ejection region 91 than in the non-ejection regions 92. During the recovery period QN, in particular, the number of pulses in the preliminary ejection signal F1*a* is larger than the number of pulses in the preliminary ejection signal F1*b*, with the result that the ink amount concerning the ejection openings 108 in the ejection region 91 is larger than the ink amount concerning the ejection openings 108 in the non-ejection regions 92. Furthermore, in all recovery periods, the total number of pulses in the preliminary vibration signals F2*a*, F2*b*, and F2*c* supplied to the individual electrode 135, i.e. the meniscus vibration frequency is larger in the ejection region 91 than in the non-ejection regions 92.

The recovery action control unit 74 adjusts the recovery action in accordance with changes in the length and position of the ejection region 91 determined by the ejection region determining unit 73. The recovery action control unit 74 determines whether the ejection region 91 of the sheet Pm includes a non-ejection region 92 of the immediately preceding sheet Pm-1. If such a region is included, the recovery action control unit 74 carries out the driving in the recovery period Qm with a driving condition "more intense" than the predetermined driving condition (i.e. a combination of the preliminary vibration signal F2*a* and the preliminary ejection signal F1*a*) of the ejection region 91, in other words, with a condition of a larger ink ejection amount and a higher meniscus vibration frequency. For example, as in the recovery period Qm in FIG. 8, the recovery action control unit 74 drives the actuators concerning the ejection region 91 by the preliminary vibration signal F2*c* and the preliminary ejection signal F1*c*. On the other hand, if it is determined that the non-ejection region is not included, the recovery action control unit 74 drives, during the recovery period Qm, the actuators concerning the ejection region 91 with the same condition as in the recovery period Qm-1, i.e. with the predetermined driving condition of these actuators.

In this regard, the recovery action control unit 74 arranges the time to supply the preliminary vibration signal F2*c* and the preliminary ejection signal F1*c* during the recovery period Qm such that the ink ejection amount and the meniscus vibration frequency of each ejection opening 108 in the ejection region 91 are larger than those in the recovery period Qm-1 during which the preliminary vibration signal F2*a* and the preliminary ejection signal F1*a* are supplied.

When focusing on the non-ejection regions 92, the recovery action control unit 74 determines whether the sheet P conveyed next is every N-th sheets among the kmaxN sheets such as PN-th sheet, P2N-th sheet, and P3N-th sheet (kmax is a natural number determined so that kmaxN is not higher than the total number of the successively conveyed sheets P), based on the amount of sheets P to be printed which is stored in the successive print amount storage unit 82. As shown in FIG. 10, when it is determined that the sheet P conveyed next is not the kN-th (k is each natural number not larger than kmax) sheet (e.g. PN-th sheet), the recovery action control unit 74 supplies only the preliminary vibration signal F2*b* to the individual electrodes 135 concerning the non-ejection regions 92 to cause the actuators concerning the non-ejection regions 92 conduct only the preliminary vibration in the next recovery period (e.g. QN-1). When it is determined that the sheet P conveyed next is the kN-th sheet (e.g. PN-th sheet), the recovery action control unit 74 serially supplies, in the next recovery period (e.g. QN), the preliminary vibration signal F2*b* and the preliminary ejection signal F1*b* to the individual electrodes 135 concerning the non-ejection regions 92 such that the preliminary vibration and the preliminary ejection are serially carried out by the actuators in the non-ejection regions 92.

As such, immediately before kN-th sheets such as PN, P2N, and P3N sheets are printed, the ejection openings 108 in the non-ejection regions 92 carry out the preliminary ejection. For this reason, when a plurality of sheets P are successively printed, even if particular ejection openings 108 are in the non-ejection regions 92 for a long time, it is possible to restrain the increase in the ink viscosity around these ejection openings 108.

In addition to the above, the recovery action control unit 74 finely adjusts the ejection cycles T1*a*, T1*b*, and T1*c* and the vibration cycles T2*a*, T2*b*, and T2*c* such that these cycles are shortened as both the temperature detected by the temperature moisture detecting unit 81 is decreased and the moisture detected by the same is increased. As a result, the ink ejection amount and the meniscus vibration frequency of each ejection opening 108 in each recovery period are increased. For example, the recovery action control unit 74 stores two thresholds (high moisture and low moisture) regarding moisture. When the detected moisture is not lower than the high moisture, the recovery action control unit 74 generates a signal in which the time lengths in which the preliminary vibration signals F2*a*, F2*b*, and F2*c* and the preliminary ejection signals F1*a*, F1*b*, and F1*c* are supplied are unchanged but the cycles are changed to be slightly longer. This slightly reduces the ink ejection amount and the meniscus vibration frequency as compared to cases where the detected moisture is between the two thresholds. On the other hand, when the detected moisture is not higher than the low moisture, the unit 74 generates a signal in which the time lengths in which the preliminary vibration signals F2*a*, F2*b*, and F2*c* and the preliminary ejection signals F1*a*, F1*b*, and F1*c* are supplied are unchanged but the cycles are changed to be slightly shorter. This slightly increases the ink ejection amount and the meniscus vibration frequency as compared to the case where the detected moisture is between the two thresholds. The recovery action control unit 74 determines the vibration cycles T2*a*, T2*b*, and T2*c* and the ejection cycles T1*a*, T1*b*, and T1*c* with reference to an unillustrated table including temperatures and moistures around the head 2 and the vibration cycles T2*a*, T2*b*, and T2*c* and the ejection cycles T1*a*, T1*b*, and T1*c* associated with these temperatures and moistures.

In addition to the above, the recovery action control unit 74 finely adjusts the vibration cycles T2*a*, T2*b*, and T2*c* and the ejection cycles T1*a*, T1*b*, and T1*c* such that they are shortened when the elapsed time t measured by the elapsed time meter 83 exceeds a predetermined time t0. This increases the ink ejection amount and the meniscus vibration frequency of each ejection opening 108 in each recovery period are increased as compared to cases where the elapsed time t is not longer than the predetermined time t0. Also in this case, the cycles are determined with reference to a table similar to the table above. It is noted that the two types of fine adjustments do not change the above-described magnitude correlations of the vibration cycles T2*a*, T2*b*, and T2*c* and the ejection cycles T2*a*, T1*b*, and T1*c*.

Figure 11:
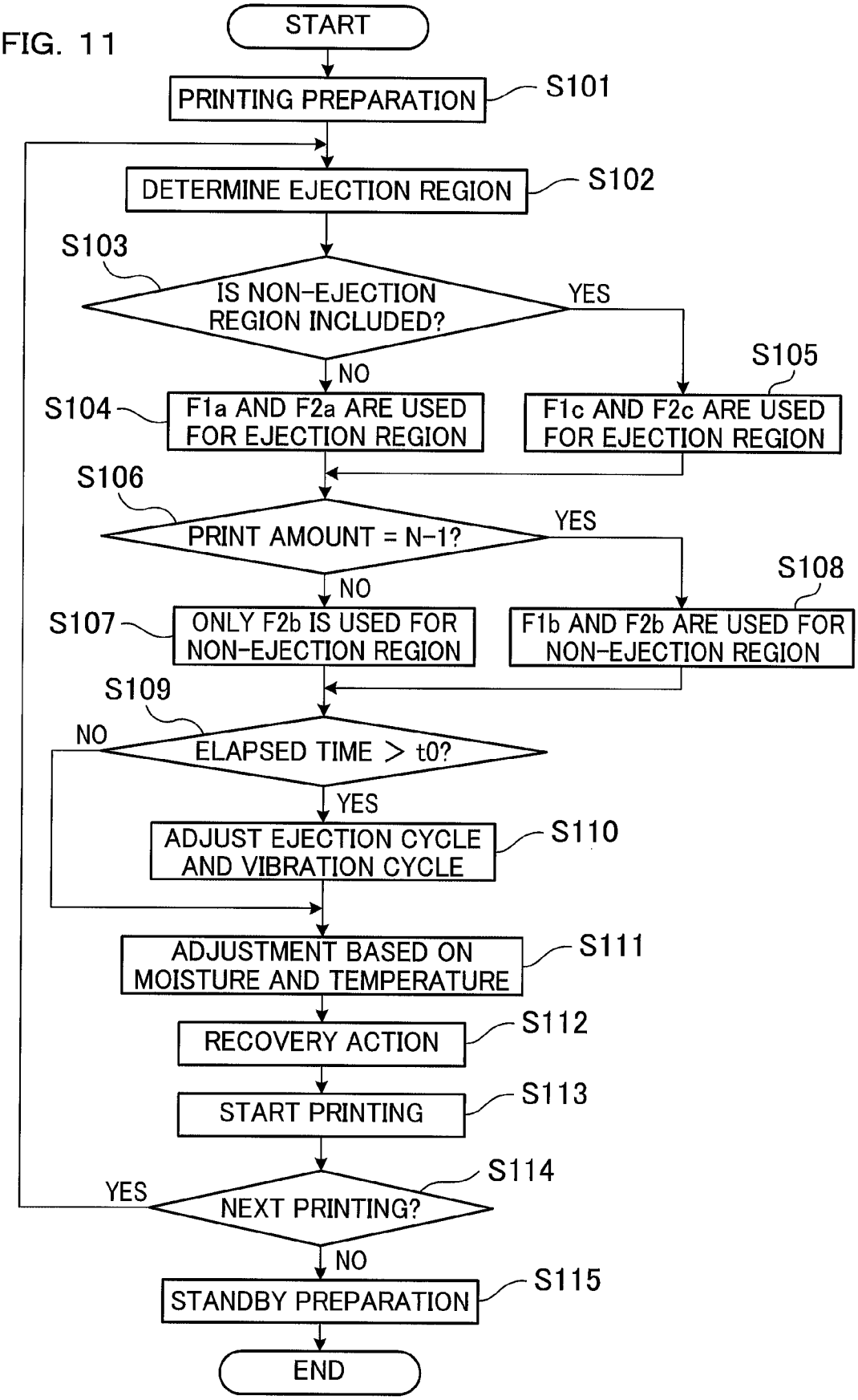
FIG. 11 is a flowchart of printing operation steps of the inkjet printer of FIG. 1.

Now, the printing operation of the printer 1 will be described with reference to FIG. 11. When the printer 1 in the standby state receives a printing instruction from a computer on the upper level, the printing operation starts. The first step in the printing operation is printing preparation (S101). The printing preparation includes detachment of the capping component (not illustrated) from the ejection surface 2*a*, start of the driving of the pickup roller 25, the belt roller 7 and so on, and resetting of the print amount stored in the successive print amount storage unit 82 (i.e. setting the print amount to zero). As the printing preparation is carried out, the printer is shifted from the standby state to the printable state. Thereafter, the length and position of the printing region in the main scanning direction of the sheet P to be printed next is detected by the ejection region determining unit 73, and based on the detected length and position in the main scanning direction of the printing region (reference printing region), the ejection region 91 and the non-ejection regions 92 of that sheet P on the ejection surface 2*a* of each head 2 are determined by the ejection region determining unit 73 (S102). The length and position thus determined are stored in the ejection region determining unit 73 until the printing operation is completed.

Whether the ejection region 91 determined by the ejection region determining unit 73 includes at least a part of the non-ejection regions 92 of the preceding sheet P in the successive printing is determined by the recovery action control unit 74 (S103). If not included (S103: NO), the recovery action control unit 74 determines what are to be done in the immediately subsequent recovery action (recovery action pattern) for the ejection region 91 such that the preliminary vibration and the preliminary ejection are carried out in this order, by serially supplying the preliminary vibration signal F2*a* and the preliminary ejection signal F1*a* to the individual electrodes 135 corresponding to the actuators concerning the ejection region 91 (S104). On the other hand, if included (S103: YES), the recovery action control unit 74 determines what are to be done in the immediately subsequent recovery action (recovery action pattern) for the ejection region 91 such that the preliminary vibration and the preliminary ejection are carried out in this order, by serially supplying the preliminary vibration signal F2*c* and the preliminary ejection signal F1*c* to the individual electrodes 135 corresponding to the actuators concerning the ejection region 91 (S105).

Furthermore, whether the number of sheets P to be printed, which is stored in the successive print amount storage unit 82, is N-1 or not is determined by the recovery action control unit 74 (S106). If the number of sheets P to be printed is not N-1 (S106: NO), the recovery action control unit 74 determines what are to be done in the immediately subsequent recovery action (recovery action pattern) for the non-ejection regions 92 such that only the preliminary vibration is carried out, by supplying only the preliminary vibration signal F2*b* to the individual electrodes 135 corresponding to the actuators concerning the non-ejection regions 92 (S107). On the other hand, if the number of sheets P to be printed is N-1 (S106: YES), the recovery action control unit 74 determines what are to be done in the immediately subsequent recovery action for the non-ejection regions 92 such that the preliminary vibration and the preliminary ejection are carried out in this order, by serially supplying the preliminary vibration signal F2*b* and the preliminary ejection signal F1*b* to the individual electrodes 135 corresponding to the actuators concerning the non-ejection regions 92 (S108).

Then whether the elapsed time t measured by the elapsed time meter 83 exceeds the predetermined time t0 is determined by the recovery action control unit 74 (S109). If the elapsed time t exceeds the predetermined time t0 (S109: YES), the recovery action control unit 74 finely adjusts the ejection cycles T1*a*, T1*b*, and T1*c* and the vibration cycles T2*a*, T2*b*, and T2*c* such that the ink ejection amount and the meniscus vibration frequency of each ejection opening 108 in the recovery period are larger than those in cases where the elapsed time t does not exceed the predetermined time t0 (S110). If the elapsed time t does not exceed the predetermined time t0 (S109: NO), the fine adjustment to shorten the ejection cycles T1*a*, T1*b*, and T1*c* and the vibration cycles T2*a*, T2*b*, and T2*c* based on the elapsed time t is not carried out.

Furthermore, as the temperature detected by the temperature moisture detecting unit 81 decreases and the moisture detected thereby increases, the recovery action control unit 74 performs fine adjustment to shorten the vibration cycles T2*a*, T2*b*, and T2*c* and the ejection cycles T1*a*, T1*b*, and T1*c* as described above (S111).

Thereafter, in the recovery period, each head 2 is controlled by the head controller 72 via the recovery action control unit 74 such that the recovery action is carried out based on the recovery action for the ejection region 91 and the recovery action for the non-ejection regions 92, which have been determined (S112). After the recovery period, each head 2 is controlled by the head controller 72 based on image data stored in the image data memory unit 71 such that a desired image is printed on the sheet P in the printing period (S113). After the printing onto the sheet P, the number of printed sheets stored in the successive print amount storage unit 82 is incremented by 1 by the control unit 16.

Thereafter, based on the printing instruction, whether printing onto the next sheet P is carried out is determined by the control unit 16 (S114). If the printing onto the next sheet P is carried out (S114: YES), the steps above are repeated from S102. If the printing onto the next sheet P is not carried out (S114: NO), standby preparation is carried out to shift the printer 1 from the printable state to the standby state by stopping the conveyance operation and sealing the ejection surface 2*a* by the unillustrated capping component (S115). The printing operation is completed in this way.

As described above, according to the present embodiment, at least one of the preliminary ejection and the preliminary vibration (at least the preliminary vibration in the present embodiment) is carried out in the recovery period not only for the ejection openings 108 in the ejection region 91 but also for the ejection openings 108 in the non-ejection regions 92. It is therefore possible to restrain the degeneration, e.g. increase in the viscosity, of the ink around all ejection openings 108. In so doing, the head 2 is driven so that the ink ejection amount regarding the preliminary ejection is larger in the ejection openings 108 in the ejection region 91 than in the ejection openings 108 in the non-ejection regions 92. Furthermore, the head 2 is driven so that the meniscus vibration frequency regarding the preliminary vibration is higher in the ejection openings 108 in the ejection region 91 than the ejection openings 108 in the non-ejection regions 92. It is therefore possible to facilitate the power saving while the ink degeneration around the ejection openings 108 in the ejection region 91 is restrained, as compared to cases where the same recovery action is carried out for all ejection openings 108.

In addition to the above, the present embodiment is arranged so that, for each head, a period until the timing immediately before the leading end of the sheet P (more preferably the leading end of the actual printing region) opposes the most upstream ejection opening 108 on the ejection surface 2*a* is set as a recovery period. For this reason the recovery action is carried out until immediately before the start of printing onto the sheet P. This makes it possible to effectively restrain the degeneration of ink around the ejection openings 108, e.g. the increase in viscosity, at the start of the printing.

Furthermore, since the sheet P which is conveyed first among a plurality of sheets P successively conveyed by the conveyance mechanism 20 is chosen as a reference sheet and the ejection region 91 and the non-ejection regions 92 are determined, it is possible to perform a suitable recovery action for each of a plurality of successively conveyed sheet P. In addition to the above, since the ejection region 91 and the non-ejection regions 92 are determined by the ejection region determining unit 73 before the start of the recovery period Q of each sheet P while all successively conveyed sheets P are set as reference sheets (i.e. for each sheet P), it is possible to certainly perform a recovery action suitable for each sheet P even if the size and/or the actual printing region of the successively conveyed sheets is changed before the completion of the printing on all sheets. Furthermore, the power saving is achievable.

In addition to the above, when the ejection region 91 includes at least a part of the non-ejection regions 92 determined for the preceding sheet P, the ink ejection amount and the meniscus vibration frequency for the ejection openings 108 in the ejection region 91 in the recovery period are arranged to be larger than those in cases where the ejection region does not include the non-ejection regions 92 at all. According to this arrangement, it is possible to certainly restrain the increase in the viscosity of the ink around the ejection openings 108 in a part of the ejection region 91 which part was a part of the non-ejection region 92 in the previously-conveyed sheet P.

In addition to the above, in each recovery period, the ejection openings 108 in the ejection region 91 perform the preliminary ejection after the preliminary vibration. Because of this, the preliminary ejection is carried out after the ink around the ejection openings 108 is stirred by the preliminary vibration, and hence it is possible to efficiently restrain the increase in the viscosity of the ink around the ejection openings 108. In other words, the degradation of ink, e.g. increase in the viscosity, is restrained while an amount of ejected ink is reduced. This makes it possible to maintain good ink ejection characteristics of the ejection openings 108 which eject ink droplets when an image is printed on a sheet P.

In addition to the above, since the ejection openings 108 in the non-ejection regions 92 perform at least the preliminary vibration which consumes less power than the preliminary ejection per unit time, it is possible to achieve both power saving and the restraint of unnecessary ink ejection, as compared to cases where only the preliminary ejection is carried out.

Furthermore, in the recovery periods Q other than the recovery periods QN concerning the N-th sheets PN among the successively printed sheets, the ejection openings 108 in the non-ejection region 92 perform only the preliminary vibration. This further facilitates the power saving and the ink amount reduction. In regard to the above, only in the recovery period QN which is immediately before the start of the printing of each of (multiples of N)-th sheets among the successively conveyed sheets P, the ejection openings 108 in the non-ejection regions 92 of that sheet PN perform the preliminary ejection. This ensures the restraint of the increase in the ink viscosity around the ejection openings 108 while achieving the power saving and ink amount reduction.

In the present embodiment, as the temperature detected by the temperature moisture detecting unit 81 decreases and the moisture detected thereby decreases, fine adjustment is carried out to shorten the vibration cycles T2*a*, T2*b*, and T2*c* and the ejection cycles T1*a*, T1*b*, and T1*c*. Since this makes it possible to carry out the control in consideration of the ambient temperature and moisture, the degradation of ink, e.g. the increase in the ink viscosity, is suitably controlled in accordance with changes in temperatures and moistures.

In the present embodiment, furthermore, when the elapsed time t measured by the elapsed time meter 83 exceeds the predetermined time t0, the vibration cycles T2*a*, T2*b*, and T2*c* and the ejection cycles T1*a*, T1*b*, and T1*c* are shortened by fine adjustment so that the ink ejection amount and the meniscus vibration frequency of each ejection opening 108 in each recovery period are larger than those in cases where the elapsed time t does not exceed the predetermined time t0. This achieves further restraint of the increase in the viscosity of the ink around the ejection openings 108.

Figure 12:
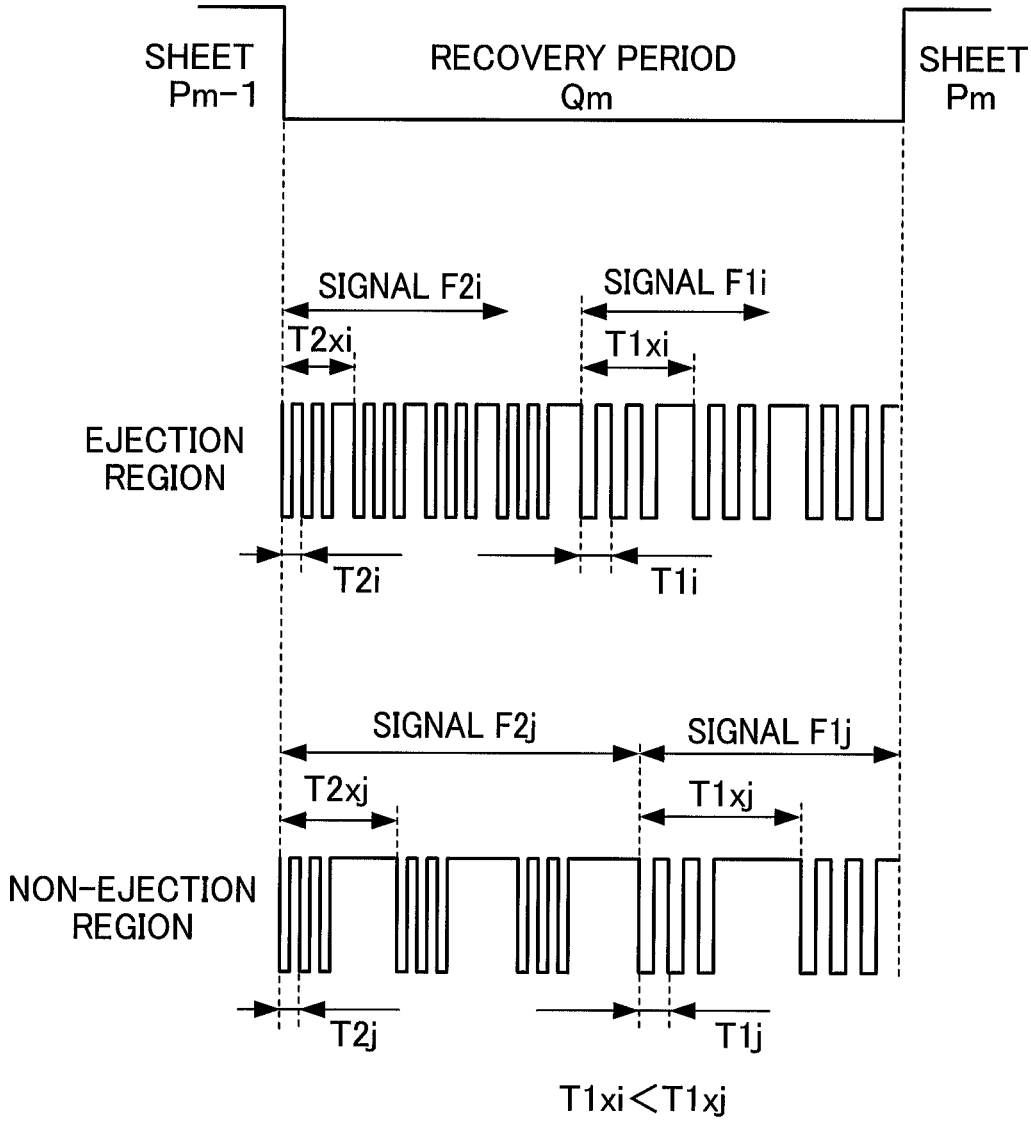
FIG. 12 illustrates a recovery action using a preliminary ejection signal including a pulse group, as a modification of the embodiment of the present invention.

The following will describe further modifications of the above-described embodiment. The preliminary ejection signal and the preliminary vibration signal may have waveforms different from those in the embodiment above. The modification deals with a case where the preliminary vibration is carried out after the preliminary ejection during the recovery period Qm, both for the ejection region and the non-ejection regions. For example, as shown in FIG. 12, each of the preliminary ejection signal F1*i* regarding the ejection region 91 and the preliminary ejection signal F1*j* regarding the non-ejection regions 92 has at least one first pulse group having first cycles T1*xi* or T1*xj*, and the first pulse group has an waveform with successive (three in FIG. 12) pulses having an ejection cycle T1*i* or T1*j* with which ink droplets are ejected from the ejection openings 108. In this example, the first cycle T1*xi* concerning the ejection region 91 is shorter than the first cycle T1*xj* concerning the non-ejection regions 92. The pulse waveform in the first pulse group concerning the ejection region 91 and the pulse waveform in the first pulse group concerning the non-ejection regions 92 are on the same cycle (first cycle T1*i*=first cycle T1*j*). Furthermore, the first pulse waveform of the preliminary ejection signals F1*i* and F1*j* is identical with the pulse waveform of the signal supplied to the actuators in the printing period to cause the ejection openings 108 to eject ink.

In this modification, the first pulse group concerning the preliminary ejection signals F1*i* and F1*j* has the same waveform as an ink ejection waveform for successively ejecting, in the printing period, three ink droplets in a single printing cycle which is a time required to convey the sheet P in the conveyance direction by a distance corresponding to the printing resolution. When in this way the ink ejection waveform supplied to the actuators when printing is carried out is arranged to be identical with the waveform of the first pulse group, only a shared waveform generation circuit is required and hence the control is simplified.

Also in FIG. 12, the preliminary vibration signal F2*i* concerning the ejection region 91 and the preliminary vibration signal F2*j* concerning the non-ejection regions 92 include at least one second pulse group having a second cycle T2*xi* or T2*xj*, and the second pulse group has an waveform with successive (three in FIG. 12) pulses having vibration cycles T2*i* or T2*j* with which the actuator unit 21 is driven on condition that the meniscus is vibrated without allowing ink droplets to be ejected through the ejection openings 108. In this example, the second cycle T2*xi* concerning the ejection region 91 is shorter than the second cycle T2*xj* concerning the non-ejection region 92.

Also in the example shown in FIG. 12, the times in which the preliminary ejection signals F1*i* and F1*j* and the preliminary vibration signals F2*i* and F2*j* are supplied during the recovery period Qm are determined so that the ink ejection amount and the meniscus vibration frequency for each ejection opening 108 in the ejection region 91 are larger than the ink ejection amount and the meniscus vibration frequency for each ejection opening 108 in the non-ejection regions 92.

In the modification, it is preferable to adjust the ink ejection amount or the meniscus vibration frequency during the recovery period by finely adjusting the first cycles T1*xi* and T1*xj* or the second cycles T2*xi* and T2*xj*. More specifically, the recovery action control unit preferably carries out a fine adjustment to shorten the first cycles T1*xi* and T1*xj* or the second cycles T2*xi* and T2*xj* as the temperature detected by the temperature moisture detecting unit 81 decreases and the moisture detected thereby increases. Since this makes it possible to carry out the control in consideration of the ambient temperature and moisture, the degradation of ink, e.g. the increase in the ink viscosity, is suitably controlled in accordance with changes in temperatures and moistures.

In addition to the above, the modification is preferably arranged so that, when non-ejection continues for not shorter than a predetermined time, the recovery action control unit performs fine adjustment to shorten the first cycles T1*xi* and T1*xj* or the second cycles T2*xi* and T2*xj* as compared to cases where the time of non-ejection is shorter than the predetermined time. This makes it possible to further restrain the increase in the viscosity of the ink around the ejection openings 108.

The following will describe another modifications. For the ejection region 91, both of the preliminary ejection and the preliminary vibration may be performed not in all recovery periods but only in some recovery periods. For example, for the ejection region 91, while a recovery action based solely on the preliminary vibration signal F2*a* is carried out in typical cases, a recovery action based on both the preliminary ejection and the preliminary vibration is carried out in the first recovery period after a predetermined number of sheets are successively printed. In this case, the recovery action of this combination may be repeated for a plurality of recovery periods. Both of these arrangements are effective in reducing power consumption. In addition to them, the above-described fine adjustment based on the temperature and the moisture may be carried out.

In the embodiment above, the ejection region 91 and the non-ejection regions 92 are determined while all sheets P conveyed by the conveyance mechanism 20 are set as reference sheets. Alternatively, only at least one of sheets P may be set as reference sheets. For example, when sheets P of the same size are successively conveyed, only the first sheet P may be set as a reference sheet or only the sheet P having the largest size is set as a reference sheet among successively printed sheet P.

In addition to the above, the embodiment above is arranged so that the ink ejection amount and the meniscus vibration frequency during a recovery period in case where the ejection region 91 includes at least a part of the non-ejection regions 92 of the preceding sheet P are arranged to be larger than those in cases where the non-ejection regions 92 are not included at all. In this regard, the ink ejection amount and the meniscus vibration frequency during a recovery period in cases where at least a part of the non-ejection regions 92 is included may be identical with those in case where the non-ejection regions 92 are not included at all.

In addition to the above, the embodiment above is arranged so that, in each recovery period, the preliminary ejection is carried out for the ejection openings 108 in the ejection region 91 after the preliminary vibration is carried out. In this regard, only one of the preliminary vibration and the preliminary ejection may be carried out for the ejection openings 108, or the preliminary vibration may be carried out after the preliminary ejection.

In addition, in each recovery period, only the preliminary ejection may be carried out for the ejection openings 108 in the non-ejection regions 92. In such a case, a preliminary ejection signal having the longest cycle among a plurality of preliminary ejection signals is preferably supplied.

In addition to the above, for the ejection openings 108 in the non-ejection regions 92, the preliminary ejection is carried out not only in the recovery periods of N-th sheets but also in the recovery periods of arbitrary recovery periods. Alternatively, only the preliminary vibration is carried out and the preliminary ejection is not carried out in all recovery periods.

In the embodiment above, fine adjustment is carried out such that, as the temperature detected by the temperature moisture detecting unit 81 decreases and the moisture detected thereby increases, the ejection cycle and the vibration cycle of the signals F1 and F2 supplied in each recovery period are shortened. In this regard, fine adjustment may be carried out based solely on the temperature or the moisture, or no fine adjustment may be done.

In addition to the above, the fine adjustment of the ejection cycle and the vibration cycle based on the elapsed time t may not be carried out.

In the embodiment above, when the ejection region 91 includes the non-ejection regions 92 of the preceding sheet P, the three types of preliminary vibration signals and the three types of preliminary ejection signals are combined so that the ink ejection amount and the meniscus vibration frequency are maximized in the recovery period Qm. Not limited to this arrangement, the scope of the present invention encompasses other arrangements in which the ink ejection amount and the meniscus vibration frequency in the recovery period are larger in case where the ejection region 91 includes the non-ejection regions 92 than in case where the ejection region 91 does not include the non-ejection regions 92 (in which case the driving is typically done with predetermined conditions (standard conditions)). For example, when included, only one of the preliminary vibration signal F2*a* and the preliminary ejection signal F1*a* is replaced with another signal having a shorter cycle. More specifically, the signals supplied to the actuators in the ejection region 91 in the recovery period Qm of FIG. 10 are replaced with the preliminary vibration signal F2*c* and the preliminary ejection signal F1*a*, or with the preliminary vibration signal F2*a* and the preliminary ejection signal F1*c*.

In addition to the above, the embodiment above is arranged so that only the driving conditions concerning the actuators in the non-ejection regions 92 are changed in every N-th sheets among successively printed sheets. In this regard, the driving conditions of the actuators in the ejection region 91 may also be changed. For example, the driving conditions of the actuators in the ejection region 91 may be changed in each M-th sheets such that the ink ejection amount and the meniscus vibration frequency are increased as compared to the standard conditions. It is noted that N may be or may not be equal to M.

In the embodiment above, the present invention is used for the printer 1 ejecting ink droplets. Not limited to this, the present invention may be used for any types of liquid ejection apparatuses ejecting liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a conveyance mechanism which conveys recording media in a conveyance direction;

a liquid ejection head having an ejection surface on which a plurality of ejection openings ejecting droplets are aligned in a direction orthogonal to the conveyance direction and a plurality of actuators which generate an ejection energy causing the droplets to be ejected through the ejection openings;

a determining unit which determines, in the ejection surface, an ejection region which opposes, when the recording media are being conveyed, a recording region where an image is recorded on a reference recording medium which is at least one of the recording media successively conveyed by the conveyance mechanism and a non-ejection region which does not oppose the recording region when the recording media are being conveyed; and a recovery action control unit which controls the actuators such that, both in the ejection openings in the ejection region and in the ejection openings in the non-ejection region, at least one of preliminary ejection with which the droplets are ejected through the ejection openings and preliminary vibration with which meniscus of liquid at each of the ejection openings is vibrated without allowing the ejection openings to eject the droplets is carried out in a recovery period in which none of the ejection openings opposes a recording region on each of the recording media on which region an image is recorded, wherein, the recovery action control unit controls the actuators such that an ejection amount of the liquid regarding the preliminary ejection in the recovery period is larger in the ejection openings in the ejection region than in the ejection openings in the non-ejection region and a frequency of vibration of the meniscus regarding the preliminary vibration in the recovery period is higher in the ejection openings in the ejection region than in the ejection openings in the non-ejection region.

2. The liquid ejection apparatus according to claim 1, wherein, the recovery period ends when the leading end of each of the recording media becomes to oppose the ejection surface.

3. The liquid ejection apparatus according to claim 2, wherein, the recovery period ends immediately before the leading end of the recording region of each of the recording media becomes to oppose one of the ejection openings which is the most upstream in the conveyance direction on the ejection surface.

4. The liquid ejection apparatus according to claim 1, wherein, the determining unit determines the ejection region and the non-ejection region of the ejection surface, provided that a recording medium which is conveyed first among the recording media which are successively conveyed by the conveyance mechanism is a reference recording medium.

5. The liquid ejection apparatus according to claim 4, wherein, the determining unit serially determines the ejection region and the non-ejection region of each of the ejection surfaces of the respective recording media before the start of each recovery period, provided that all of the recording media successively conveyed by the conveyance mechanism are reference recording media.

6. The liquid ejection apparatus according to claim 5, wherein, the recovery action control unit controls the actuators such that, in the recovery period after recording onto a (m-1) th recording medium and before recording onto a m-th recording medium, at least one of the amount of ejection regarding the preliminary ejection and the frequency of vibration regarding the preliminary vibration is greater in the ejection region of the m-th recording medium which includes at least a part of the non-ejection region of the (m-1)th recording medium than in the ejection region of the m-th recording medium which does not include the non-ejection region of the (m-1)th recording medium at all, wherein m is a natural number not smaller than 2.

7. The liquid ejection apparatus according to claim 1, wherein, the recovery action control unit controls the actuators such that, in the ejection openings in the ejection region, the preliminary ejection is carried out after the preliminary vibration in the recovery period.

8. The liquid ejection apparatus according to claim 1, wherein, the recovery action control unit controls the actuators such that, in the ejection openings in the non-ejection region, at least the preliminary vibration is carried out in the recovery period.

9. The liquid ejection apparatus according to claim 1, wherein, the recovery action control unit controls the actuators such that, for the ejection openings in the non-ejection region of every N-th recording medium among kmaxN recording media which are successively conveyed by the conveyance mechanism, the preliminary ejection is carried out in the recovery period between recording onto the (kN-1)-th recording medium and recording onto the kN-th recording medium, whereas only the preliminary vibration is carried out for the ejection openings in the non-ejection region of each of the remaining recording media in the corresponding recovery period, wherein N is a natural number not smaller than 2, kmax is a natural number determined so that kmaxN is not larger than the total number of the recording media which are successively conveyed, and k is each natural number not larger than kmax.

10. The liquid ejection apparatus according to claim 1, further comprising:

a moisture detector which detects a moisture around the liquid ejection head, wherein, the recovery action control unit shortens a cycle of pulses in a preliminary ejection signal and a preliminary vibration signal supplied to the actuators, as the moisture detected by the moisture detector decreases.

11. The liquid ejection apparatus according to claim 1, wherein, when a non-ejection period between the end of ejection of the droplets through the ejection openings onto a (m-1)-th recording medium and the start of the recovery period between recording onto the (m-1)-th recording medium and recording onto a m-th recording medium is not shorter than a predetermined time, the recovery action control unit arranges a cycle of pulses of a preliminary ejection signal and a preliminary vibration signal supplied to the actuators in the recovery period to be shorter than the cycle in case where the non-ejection period is shorter than the predetermined time.

12. The liquid ejection apparatus according to claim 1, wherein, the recovery action control unit carries out:

as a signal supplied to the actuators performing the preliminary ejection, generation of a preliminary ejection signal in which a first pulse group including successive pulses having an ejection cycle with which the droplets are ejected through the ejection openings is repeated with a first cycle;

control of the actuators such that the preliminary ejection is carried out during the recovery period by both the ejection openings in the ejection region and the ejection openings in the non-ejection region; and setting to shorten the first cycle of the preliminary ejection signal supplied to the actuators corresponding to the ejection openings in the ejection region as compared to the first cycle of the preliminary ejection signal supplied to the actuators corresponding to the ejection openings in the non-ejection region.

13. The liquid ejection apparatus according to claim 12, further comprising:

a moisture detector which detects a moisture around the liquid ejection head, wherein, the recovery action control unit shortens the first cycle of the two types of the preliminary ejection signal as the moisture detected by the moisture detector decreases.

14. The liquid ejection apparatus according to claim 12, wherein, when a non-ejection period between the end of ejection of the droplets through the ejection openings onto a (m-1)-th recording medium and the start of the recovery period between recording onto the (m-1)-th recording medium and recording onto a m-th recording medium is not shorter than a predetermined time, the recovery action control unit arranges the first cycle of the preliminary ejection signal supplied to the actuators in the recovery period to be shorter than the cycle in case where the non-ejection period is shorter than the predetermined time.

15. The liquid ejection apparatus according to claim 1, wherein, the recovery action control unit carries out:

as a signal supplied to the actuators performing the preliminary vibration, generation of a preliminary vibration signal in which a second pulse group including successively pulses having a vibration cycle with which the meniscus at each of the ejection openings is vibrated is repeated with a second cycle;

control of the actuators such that the preliminary vibration is carried out during the recovery period by both the ejection openings in the ejection region and the ejection openings in the non-ejection region; and setting to shorten the second cycle of the preliminary vibration signal supplied to the actuators corresponding to the ejection openings in the ejection region as compared to the second cycle of the preliminary vibration signal supplied to the actuators corresponding to the ejection openings in the non-ejection region.

16. The liquid ejection apparatus according to claim 15, further comprising:

a moisture detector which detects a moisture around the liquid ejection head, wherein, the recovery action control unit shortens the second cycle of the preliminary vibration signal as the moisture detected by the moisture detector decreases.

17. The liquid ejection apparatus according to claim 15, wherein, when a non-ejection period between the end of ejection of the droplets through the ejection openings onto a (m-1)-th recording medium and the start of the recovery period between recording onto the (m-1)-th recording medium and recording onto a m-th recording medium is not shorter than a predetermined time, the recovery action control unit arranges the second cycle of the preliminary vibration signal supplied to the actuators in the recovery period to be shorter than the cycle in case where the non-ejection period is shorter than the predetermined time.

* * * * *